US009150024B2

(12) United States Patent
Karasawa et al.

(10) Patent No.: US 9,150,024 B2
(45) Date of Patent: Oct. 6, 2015

(54) LIQUID CONTAINING VESSEL, LIQUID CONTAINING BODY, SUBSTRATE SUPPORT MEMBER, AND UNIT

(71) Applicant: SEIKO EPSON CORPORATION, Tokyo (JP)

(72) Inventors: Masahiro Karasawa, Nagano (JP); Ryota Takahashi, Nagano (JP); Seiko Hamamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/488,918

(22) Filed: Sep. 17, 2014

(65) Prior Publication Data

US 2015/0085027 A1 Mar. 26, 2015

(30) Foreign Application Priority Data

Sep. 20, 2013 (JP) ..... 2013-196108

(51) Int. Cl.
*B41J 2/175* (2006.01)

(52) U.S. Cl.
CPC ..... *B41J 2/1752* (2013.01); *B41J 2/17596* (2013.01)

(58) Field of Classification Search
None
See application file for complete search history.

(56) References Cited

U.S. PATENT DOCUMENTS

2005/0243148 A1* 11/2005 Miyazawa et al. ..... 347/86
2013/0307908 A1* 11/2013 Aoki et al. ..... 347/86

FOREIGN PATENT DOCUMENTS

WO 2004/037541 A1 5/2004

* cited by examiner

*Primary Examiner* — Geoffrey Mruk
*Assistant Examiner* — Bradley Thies
(74) *Attorney, Agent, or Firm* — Global IP Counselors, LLP

(57) ABSTRACT

In a liquid containing vessel inserted in a −Y axis direction, a substrate support member includes a first engaging section engaging with the liquid containing vessel from a +Z axis direction side at a position more to the −Y axis direction side than a contact section of a substrate, a second engaging section engaging with a liquid containing section at a position more to a +Y axis direction side than the substrate and is provided more to a −Z axis direction side than the contact section, a first pressed section receiving a first pressing force with a component in the −Z axis direction at a position more to the −Y axis direction side than the contact section, and a second pressed section receiving a second pressing force with a component in the −Z axis direction at a position more to the +Y axis direction side than the contact section.

17 Claims, 31 Drawing Sheets

LIQUID CONTAINING VESSEL, LIQUID CONTAINING BODY, SUBSTRATE SUPPORT MEMBER, AND UNIT

CROSS-REFERENCE TO RELATED APPLICATIONS

This application claims priority to Japanese Patent Application No. 2013-196108 filed on Sep. 20, 2013. The entire disclosure of Japanese Patent Application No. 2013-196108 is hereby incorporated herein by reference.

BACKGROUND

1. Technical Field

The present invention relates to a liquid containing vessel, a liquid containing body, a substrate support member, and a unit 2. Related Art A liquid containing vessel (an ink cartridge) is disclosed in WO 2004/037541 (PTL 1) which is mounted in a liquid ejecting apparatus (a printer) so as to be able to be attached and detached and which contains a liquid containing body which has flexibility (an ink pack) inside a casing section which is rigid. In the liquid containing body in PTL 1, a substrate is provided through a substrate support member. Information relating to a liquid which is contained in the liquid containing body is stored on the substrate. In a case where the liquid containing vessel is mounted in the liquid ejecting apparatus, the liquid ejecting apparatus receives supply of the liquid from the liquid containing body and is connected with the substrate with which access is possible.

SUMMARY

There is a problem in the liquid containing vessel in PTL 1 in that, since conduction paths between the substrate and the liquid ejecting apparatus are formed by linking a plurality of conduction members in the casing section, each of the plurality of conducting members in the casing section may become a cause for conduction faults. In addition, it is desirable for the liquid containing vessel to be smaller in size, save energy, be easier to manufacture, have improved usability, and the like.

The present invention is conceived in order to solve at least a portion of the problems described above and is able to be realized in the following aspects.

(1) According to an aspect of the present invention, a substrate support member is provided. The substrate support member is configured to support a substrate in a liquid ejecting apparatus that includes a liquid containing body with a flexible liquid containing section that contains a liquid, a liquid containing vessel that contains the liquid containing body, a mounting section to which the liquid containing vessel is attachably and detachably mounted, the mounting section having an apparatus side insertion opening that is formed on a +Y axis direction side and an apparatus side wall section that is formed on a −Y axis direction side, and the liquid containing vessel being inserted in the mounting section in the −Y axis direction from the apparatus side insertion opening to the apparatus side wall section, a liquid supply tube provided to the apparatus side wall section and receiving supply of the liquid from the liquid containing body, and an apparatus side terminal section provided to the apparatus side wall section and electrically connected due to contact with regard to a contact section of the substrate that is provided in the liquid containing body, where three spatial axes that are orthogonal to each other have an X axis, a Y axis, and a Z axis where, out of X axis directions along the X axis, a positive direction is a +X axis direction and a negative direction is a −X axis direction, out of Y axis directions along the Y axis, a positive direction is the +Y axis direction and a negative direction is the −Y axis direction, and out of Z axis directions along the Z axis, a positive direction is a +Z axis direction and a negative direction is a −Z axis direction.

The substrate support member includes a first engaging section configured to engage with regard to the liquid containing vessel from the +Z axis direction side at a position more to the −Y axis direction side than the contact section, a second engaging section configured to engage with the liquid containing section at a position more to the +Y axis direction side than the substrate, and provided more to the −Z axis direction side than the contact section, a first pressed section configured to receive a first pressing force with a component in the −Z axis direction at a position more to the −Y axis direction side than the contact section, and a second pressed section configured to receive a second pressing force with a component in the −Z axis direction at a position more to the +Y axis direction side than the contact section, where the X axis, the Y axis, and the Z axis with regard to the liquid containing vessel in a state of being mounted in the mounting section are three spatial axes in the liquid containing vessel. According to this aspect, since the substrate support member is positionally aligned in the liquid containing vessel at both positions on the +Y axis direction and the −Y axis direction of the contact section with regard to the Y axis direction in which the liquid containing vessel is inserted, it is possible to prevent positional deviation of the contact section which accompanies inserting of the liquid containing vessel in the mounting section. Accordingly, electrical connection between the substrate and the liquid ejecting apparatus is possible without forming conduction paths in the liquid containing vessel. As a result, it is possible to suppress conduction problems between the substrate and the liquid ejecting apparatus.

(2) In the substrate support member in the aspect described above, a substrate support section is configured to hold the substrate with a posturing where the contact section faces the −Y axis direction and the +Z axis direction. According to this aspect, it is possible to suppress contact problems between the contact section and the apparatus side terminal section.

(3) In the substrate support member in the aspect described above, the second pressed section is configured to receive the second pressing force at a position more to the +Z axis direction side than a position where the first pressed section receives the first pressing force. According to this aspect, it is possible to prevent damage to the liquid containing section due to a member which presses the second pressed section since it is possible to separate between the second pressed section and the liquid containing section in the Z axis direction.

(4) In the substrate support member in the aspect described above, there is a plurality of the first engaging sections. According to this aspect, it is possible to achieve easier positional aligning of the substrate support member in the liquid containing vessel and to further prevent positional deviation of the substrate which accompanies inserting of the liquid containing vessel in the mounting section.

According to an aspect of the present invention, a unit is provided. The unit includes a substrate having a contact section, the substrate being configured to be detachably attached to a liquid ejecting apparatus in an attaching and detaching direction, a first pressed section pressed in a direction that intersects with the attaching and detaching direction more to a downstream side than the contact section in the attaching and detaching direction, and a second pressed section pressed in a direction that intersects with the attaching and detaching direction more to an upstream side than the contact section in the attaching and detaching direction. According to this aspect, it is possible to prevent positional deviation of the contact section at positions in both the +Y axis direction and the −Y axis direction of the contact section with regard to the attaching and detaching direction.

The plurality of the constituent elements in each of the aspects of the present invention described above are not all essential and it is possible for a portion of the plurality of constituent elements to be appropriately modified, omitted, replaced with new constituent elements, or partially omitted for limited content in order to solve a portion or all of the problems described above or achieve a portion or all of the effects which are described in the specifications. In addition, it is possible for a portion or all of the technical features which are include in the aspects of the present invention described above to be combined with a portion or all of the technical features which are include in the other aspects of the present invention described above and it is possible for the aspects of the invention to be independent in order to solve a portion or all of the problems described above or achieve a portion or all of the effects which are described in the specifications.

For example, it is possible for the aspect of the present invention to be realized as an apparatus which is provided with one or more elements out of the four elements of the first engaging section, the second engaging section, the first pressed section, and the second pressed section. That is, the apparatus of the present invention may or may not have the first engaging section. In addition, the apparatus of the present invention may or may not have the second engaging section. In addition, the apparatus of the present invention may or may not have the first pressed section. In addition, the apparatus of the present invention may or may not have the second pressed section.

The first engaging section may be configured as, for example, the first engaging section which engages with regard to the liquid containing vessel in the +Z axis direction more to the −Y axis direction side than the substrate. The second engaging section may be configured as, for example, the second engaging section which engages with the liquid containing section at a position more to the +Y axis direction side than the substrate and which is provided more to the −Z axis direction side than the substrate. The first pressed section may be configured as, for example, the first pressed section which receives a first pressing force which includes components in the −Z axis direction at a position more to the −Y axis direction side than the substrate. The second pressed section may be configured as, for example, the second pressed section which receives a second pressing force which includes components in the −Z axis direction at a position more to the +Y axis direction side than the substrate.

It is possible for such apparatuses to be realized as, for example, the substrate support member but it is possible for such apparatuses to be realized as an apparatus other than the substrate support member. According to this aspect, it is possible to solve at least one of the various problems such as providing an apparatus which is smaller in size, has lower costs, saves energy, is easier to manufacture, has improved usability, and the like. It is possible for a portion or all of the technical features in each aspect of the substrate support member described above to be applied to such apparatuses.

It is possible for the present invention to be released as various aspects other than the substrate support member. For example, it is possible to realize the present invention as aspects such as a liquid containing body, a liquid containing vessel, a liquid ejecting apparatus, and the manufacturing methods of these.

BRIEF DESCRIPTION OF THE DRAWINGS

Referring now to the attached drawings which form a part of this original disclosure.

DETAILED DESCRIPTION OF EMBODIMENTS

A. First Embodiment

A-1. Configuration of Printing Apparatus

Figure 1:
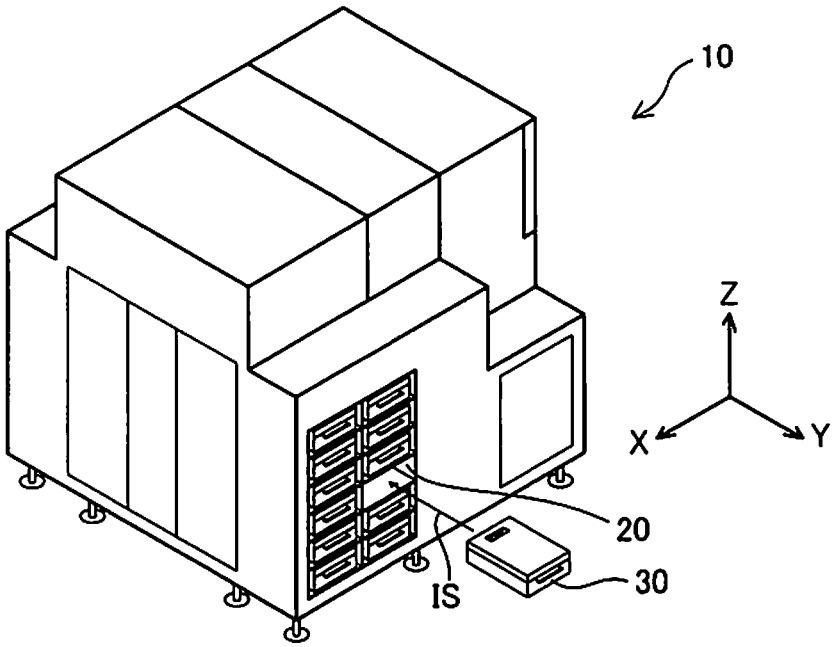
FIG. 1 is a perspective diagram illustrating a printing apparatus.

FIG. 1 is a perspective diagram illustrating a printing apparatus 10. The printing apparatus 10 is a liquid ejecting apparatus which ejects ink as a liquid. In the present embodiment, the printing apparatus 10 is a so-called ink jet printer. In the present embodiment, ink which is used in the printing apparatus 10 is a UV ink which is a material for printing with liquid which is cured by illuminating with ultraviolet rays. In the present embodiment, the printing apparatus 10 ejects UV ink as liquid droplets with regard to a resin film (for example, a film for a plastic bottle label) which is a target for printing, and a plurality of unit images are continuously printed onto the resin film by the UV ink on the resin film being illuminating with ultraviolet rays.

The X, Y, and Z axes are diagrammatically shown in FIG. 1. The X, Y, and Z axes in FIG. 1 have an X axis, a Y axis, and a Z axis as three spatial axis which are orthogonal to each other. Out of the X axis directions along the X axis, the +X axis direction is a positive direction and the −X axis direction is a negative direction. Out of the Y axis directions along the Y axis, the +Y axis direction is a positive direction and the −Y axis direction is a negative direction. Out of the Z axis directions along the Z axis, the +Z axis direction is a positive direction and the −Z axis direction is a negative direction. In the present embodiment, the XY plane is the horizontal plane and the −Z axis direction is the gravity direction. The X, Y, and Z axes in FIG. 1 correspond to the X, Y, and Z axes in the other diagrams. In the explanation of the present embodiment, the three spatial axes in an ink cartridge 30 and other constituent elements are the X, Y, and Z axes which correspond to the ink cartridge 30 and other constituent elements in a state of being mounted in a cartridge holder 20.

The printing apparatus 10 is provided with the cartridge holder 20 and the ink cartridge 30. The cartridge holder 20 of the printing apparatus 10 is a mounting section for mounting the ink cartridge 30 so as to be able to attached and detached. The ink cartridge 30 of the printing apparatus 10 is a liquid containing vessel for containing UV ink which is a liquid.

In the present embodiment, it is possible for the user of the printing apparatus 10 to mount the ink cartridge 30 in the cartridge holder 20 due to the ink cartridge 30 being inserted with regard to the cartridge holder 20 in the −Y axis direction. That is, the −Y axis direction is an insertion direction IS in which the ink cartridge 30 is inserted with regard to the cartridge holder 20. In the present embodiment, it is possible for the user of the printing apparatus 10 to remove the ink cartridge 30 from the cartridge holder 20 due to the ink cartridge 30 which is mounted in the cartridge holder 20 being extracted in the +Y axis direction. The −Y axis direction side is the downstream side in an attaching and detaching direction and the +Y axis direction side is the upstream side in an attaching and detaching direction.

In the present embodiment, the printing apparatus 10 is provided with a plurality of the cartridge holders 20 where it is possible for a plurality of the ink cartridges 30 to be mounted. In the present embodiment, the printing apparatus 10 is provided with 12 of the cartridge holders 20 where it is possible for 12 of the ink cartridges 30 to be mounted. In the present embodiment, the 12 of the cartridge holders 20 are arranged in six rows and two columns with the X axis direction as the row direction and the Z axis direction as the column direction. It is possible for the number of the cartridge holders 20 in the printing apparatus 10 to be changed to an arbitrary number without being limited to 12 and there may be less than 12 or there may be more than 12.

In the present embodiment, two each of six types of liquid containing vessels are mounted in the printing apparatus 10 to correspond to the UV ink with six colors (cyan (C), magenta (M), yellow (Y), black (K), blue (B), and white (W). The types of UV ink which is used in the printing apparatus 10 are not limited to six types and may be more than six types or may be less than six types.

Figure 2:
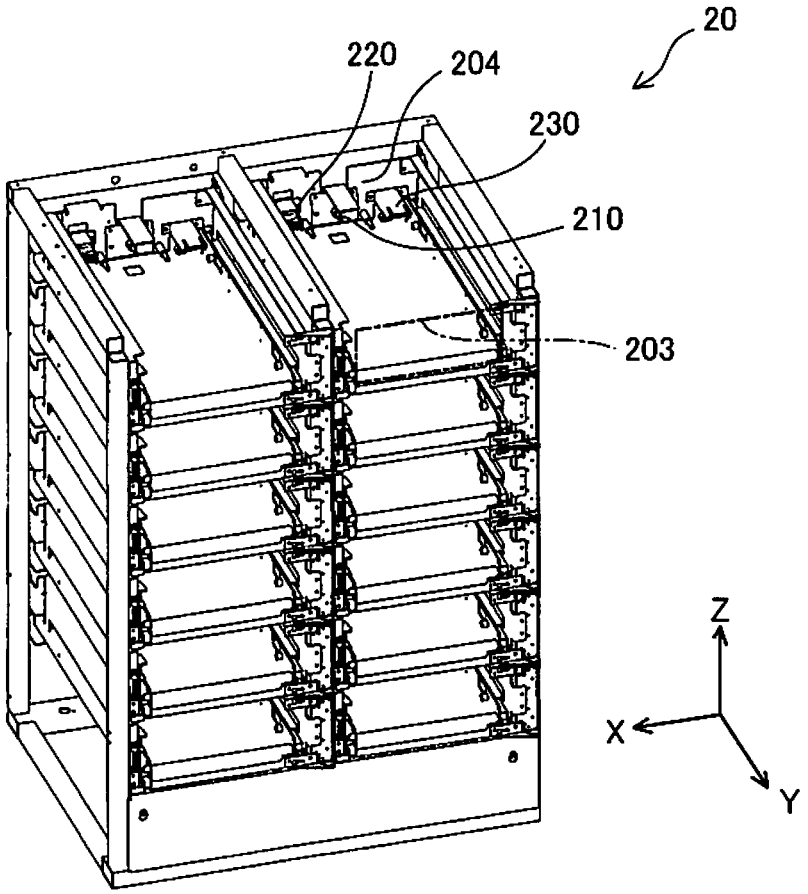
FIG. 2 is a perspective diagram illustrating a cartridge holder of a printing apparatus.

FIG. 2 is a perspective diagram illustrating the cartridge holder 20 of the printing apparatus 10. The cartridge holder 20 has an apparatus side insertion opening 203 and an apparatus side wall section 204. The ink cartridge 30 is mounted with regard to the cartridge holder 20 as to be able to be attached and detached by being inserted in the −Y axis direction from the apparatus side insertion opening 203 to the apparatus side wall section 204.

The apparatus side insertion opening 203 of the cartridge holder 20 is formed on the +Y axis direction side in the cartridge holder 20. The apparatus side insertion opening 203 is an opening with a size which is sufficient for it to be possible to extract the ink cartridge 30.

The apparatus side wall section 204 of the cartridge holder 20 is formed on the −Y axis direction side in the cartridge holder 20. The apparatus side wall section 204 is a wall along the ZX plane. A liquid supply tube 210 and an apparatus side terminal section 220 are provided in the apparatus side wall section 204. In the present embodiment, the liquid supply tube 210 is positioned at the center of the apparatus side wall section 204 in the X axis direction and the apparatus side terminal section 220 is positioned more to the +X axis direction side than the liquid supply tube 210.

The liquid supply tube 210 receives supply of UV ink from the ink cartridge 30 which is mounted in the cartridge holder 20. The liquid supply tube 210 protrudes from the apparatus side wall section 204 in the +Y axis direction. The liquid supply tube 210 is inserted in the ink cartridge 30 to accompany the ink cartridge 30 being mounted with regard to the cartridge holder 20.

The apparatus side terminal section 220 is electrically connected due to contact with the ink cartridge 30 which is mounted in the cartridge holder 20. The apparatus side terminal section 220 protrudes from the apparatus side wall section 204 in the +Y axis direction. The apparatus side terminal section 220 is inserted in the ink cartridge 30 to accompany the ink cartridge 30 being mounted with regard to the cartridge holder 20.

In the present embodiment, an apparatus side identifying section 230 is further provided in the apparatus side wall section 204. In the present embodiment, the apparatus side identifying section 230 is positioned more to the −X axis direction side than the liquid supply tube 210. The apparatus side identifying section 230 identifies the color of UV ink which is contained in the ink cartridge 30 which is mounted in the cartridge holder 20. The apparatus side identifying section 230 protrudes from the apparatus side wall section 204 in the +Y axis direction. The apparatus side identifying section 230 is inserted in the ink cartridge 30 to accompany the ink cartridge 30 being mounted with regard to the cartridge holder 20.

Figure 3:
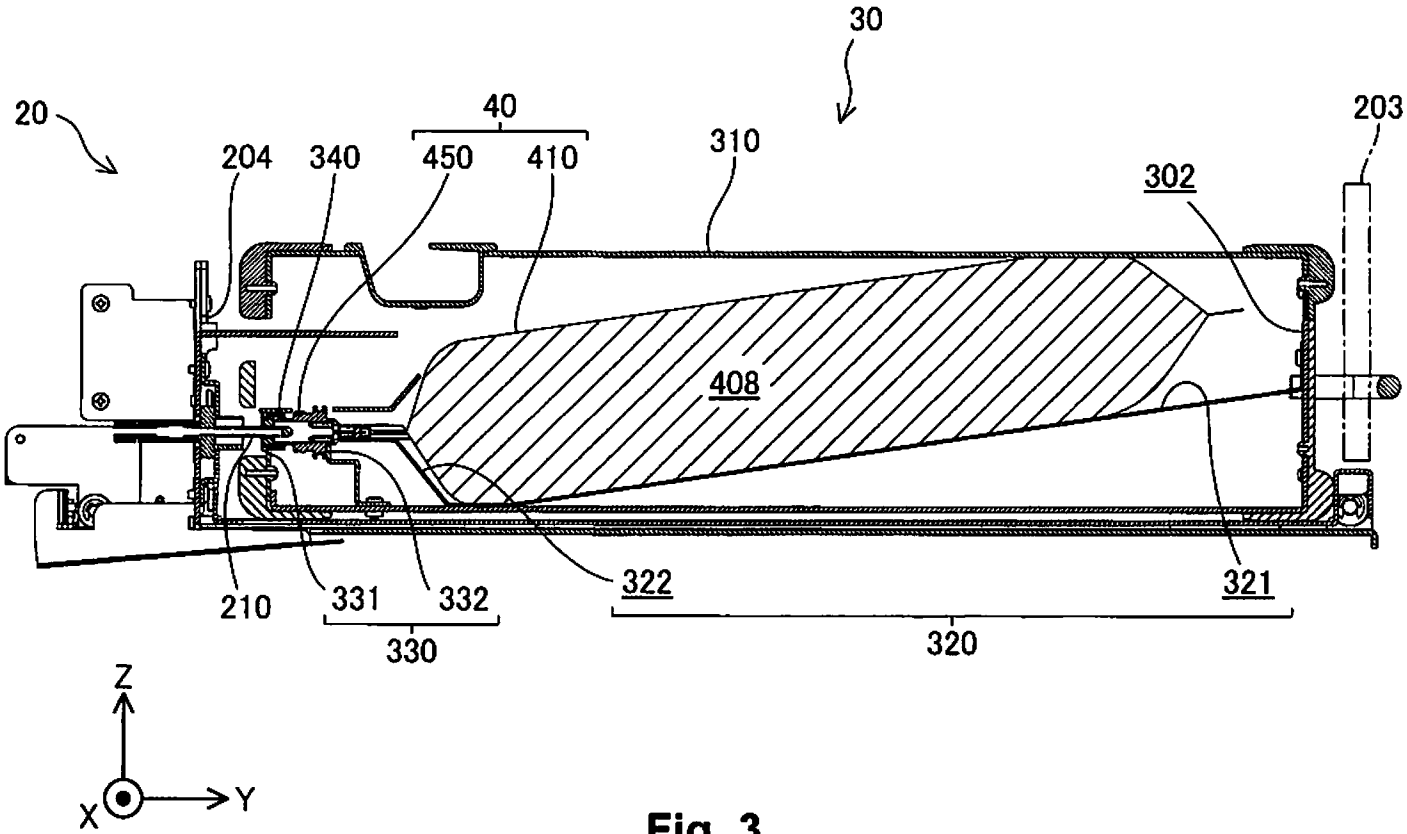
FIG. 3 is a cross sectional diagram illustrating a cartridge holder in which an ink cartridge is mounted.

FIG. 3 is a cross sectional diagram illustrating the cartridge holder 20 in which the ink cartridge 30 is mounted. The cross sectional diagram of FIG. 3 is a diagram of the cartridge holder 20 in which the ink cartridge 30 is mounted where a cross section, which is cut along the YZ plane at a position to pass through the liquid supply tube 210, is viewed from the +X axis direction. The ink cartridge 30 is provided with an ink pack 40, a casing section 310, a placement member 320, a platform member 330, and a pressing member 340.

The ink pack 40 is a liquid containing body where UV ink which is the liquid is contained. The ink pack 40 is provided with a liquid containing section 410 and a liquid supply member 450. The liquid containing section 410 of the ink pack 40 is a member where a thin plate (a film) which has flexibility is formed in a bag shape. The liquid containing section 410 has a liquid inflow section 408 which permits inflow of UV ink between a plurality of flexible wall surfaces. UV ink is contained in the liquid inflow section 408. The liquid supply member 450 of the ink pack 40 is a member which is formed with a cylindrical shape and is provided on the −Y axis direction side of the liquid containing section 410 to face the −Y axis direction side. The liquid supply tube 210 of the cartridge holder 20 is inserted in the liquid supply member 450 to accompany the ink cartridge 30 being mounted with regard to the cartridge holder 20 and the liquid supply member 450 supplies UV ink from the liquid containing section 410 to the liquid supply tube 210.

The casing section 310 of the ink cartridge 30 is a casing where members which are rigid are assembled into a box shape. The ink pack 40 is contained in the casing section 310. The casing section 310 has a wall section 302 which is positioned on the −Y axis direction side of the casing section 310. The wall section 302 configures a wall along the ZX plane. In the present embodiment, the liquid containing section 410 of the ink pack 40 is arranged at a position which is separated from the wall section 302.

The placement member 320 of the ink cartridge 30 is a member which is provided at an inner side of the casing section 310. The placement member 320 has an inner wall 321 and an inner wall 322. The inner wall 321 of the placement member 320 is a wall which faces the −Y axis direction and the +Z axis direction. That is, the inner wall 321 is positioned so that the −Y axis direction side is more to the −Z axis direction side than the +Y axis direction side. The −Y axis direction side of the inner wall 321 links with the wall section 302 of the casing section 310. The liquid containing section 410 of the ink pack 40 is placed on the +Z axis direction side of the inner wall 321. The inner wall 322 of the placement member 320 is a wall which faces the +Y axis direction and the +Z axis direction. The −Y axis direction side of the inner wall 322 links with the inner wall 321. In the present embodiment, the liquid containing section 410 of the ink pack 40 is arranged at a position which is separated from the inner wall 322.

The platform member 330 of the ink cartridge 30 is a member which is provided at an inner side of the casing section 310 more to the −Y axis direction side than the placement member 320. The platform member 330 has a regulating section 331 and a regulating section 332. The regulating section 331 of the platform member 330 is a first regulating section which regulates movement of the liquid supply member 450 in the −Z axis direction due to contacting with regard to the liquid supply member 450 of the ink pack 40 from the −Z axis direction. The regulating section 332 of the platform member 330 is a second regulating section which regulates movement of the liquid supply member 450 in the −Z axis direction due to contacting with regard to the liquid supply member 450 of the ink pack 40 from the −Z axis direction and which is positioned more to the +Y axis direction side than the regulating section 331.

The pressing member 340 of the ink cartridge 30 is a member which is provided at an inner side of the casing section 310. The pressing member 340 pushes the liquid supply member 450 of the ink pack 40 in the −Z axis direction.

Figure 4:
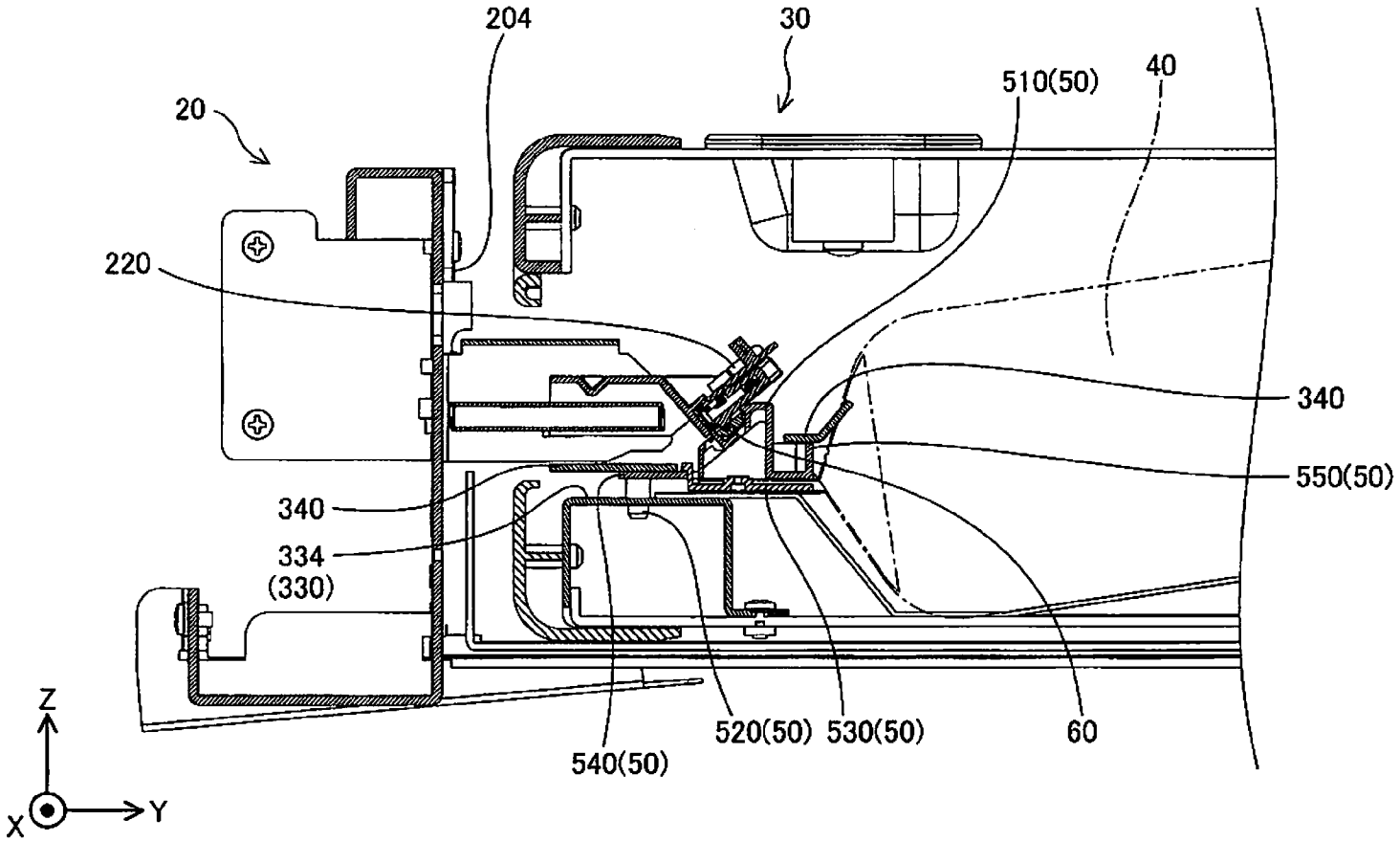
FIG. 4 is a cross sectional diagram illustrating a cartridge holder in which an ink cartridge is mounted.

FIG. 4 is a cross sectional diagram illustrating the cartridge holder 20 in which the ink cartridge 30 is mounted. The cross sectional diagram of FIG. 4 is a diagram of the cartridge holder 20 in which the ink cartridge 30 is mounted where a cross section, which is cut along the YZ plane at a position to pass through the apparatus side terminal section 220, is viewed from the +X axis direction. The ink cartridge 30 is further provided with a substrate holder 50 and a substrate 60.

The substrate holder 50 is a substrate support member which supports the substrate 60. The substrate holder 50 is also a unit which determines the contact position of the contact section of the substrate 60 and the apparatus side terminal section 220. Information related to UV ink which is contained in the ink pack 40 is stored in the substrate 60. The apparatus side terminal section 220 of the cartridge holder 20 is electrically connected due to contact with the substrate 60 to accompany the ink cartridge 30 being mounted with regard to the cartridge holder 20 and it is possible for the printing apparatus 10 to achieve access with regard to information which is stored in the substrate 60.

The substrate holder 50 has a substrate holding section 510, an engaging section 520, an engaging section 530, a pressed section 540, and a pressed section 550. The substrate holding section 510 of the substrate holder 50 is a part which holds the substrate 60. In the present embodiment, the substrate holding section 510 holds the substrate 60 with a posturing so that the substrate 60 faces the −Y axis direction and the +Z axis direction.

The engaging section 520 of the substrate holder 50 is a first engaging section which engages with regard to the platform member 330 of the ink cartridge 30 from the +Z axis direction side at a position more to the −Y axis direction side than the substrate 60 which is held by the substrate holding section 510. In the present embodiment, the platform member 330 has a wall section 334 along the XY plane and the engaging section 520 is positionally aligned on the +Z axis direction side of the wall section 334.

The engaging section 530 of the substrate holder 50 is a second engaging section which is provided more to the −Z axis direction side than the substrate 60 which is held by the substrate holding section 510 and which engages with the ink pack 40 at a position more to the +Y axis direction side than the substrate 60 which is held by the substrate holding section 510. In the present embodiment, the engaging section 530 engages with the liquid containing section 410 of the ink pack 40 across from a position which overlaps with the substrate 60 in the Y axis direction to a position more to the +Y axis direction side than the substrate 60. In the present embodiment, the substrate holding section 510 and the engaging section 530 are two separate members, and the liquid containing section 410 of the ink pack 40 is interposed by the substrate holding section 510 and the engaging section 530.

The pressed section 540 of the substrate holder 50 is a first pressed section which receives a first pressing force which includes components in the −Z axis direction at a position more to the −Y axis direction side than the substrate 60 which is held by the substrate holding section 510. In the present embodiment, the pressed section 540 is pushed in the −Z axis direction by the pressing member 340 of the ink cartridge 30.

The pressed section 550 of the substrate holder 50 is a second pressed section which receives a second pressing force which includes components in the −Z axis direction at a position more to the +Y axis direction side than the substrate 60 which is held by the substrate holding section 510. In the present embodiment, the pressed section 550 is pushed in the −Z axis direction by the pressing member 340 of the ink cartridge 30. In the present embodiment, the pressed section 550 receives the second pressing force at a position more to the +Z axis direction side than the position where the pressed section 540 receives the first pressing force. That is, the pressed section 550 is pushed in the −Z axis direction by the pressing member 340 at a position more to the +Z axis direction side than a position where the pressed section 540 is pushed in the −Z axis direction by the pressing member 340.

Figure 5:
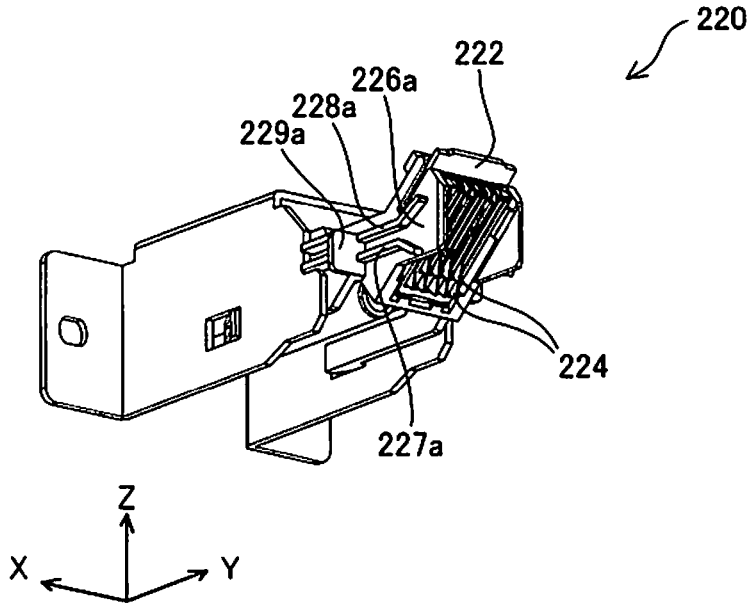
FIG. 5 is a perspective diagram illustrating an apparatus side terminal section of a printing apparatus.
Figure 6:
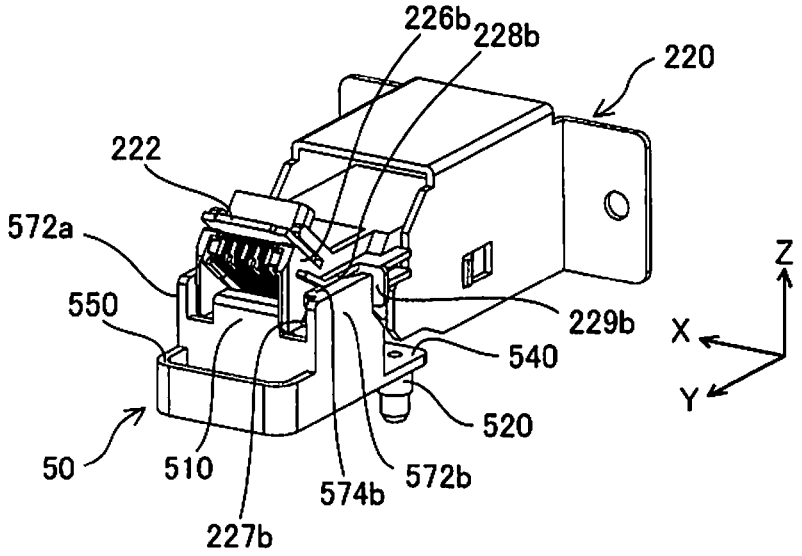
FIG. 6 is a perspective diagram illustrating an apparatus side terminal section to which a substrate holder is attached.

FIG. 5 is a perspective diagram illustrating the apparatus side terminal section 220 of the printing apparatus 10. FIG. 6 is a perspective diagram illustrating the apparatus side terminal section 220 to which the substrate holder 50 is attached. The apparatus side terminal section 220 has a terminal holding section 222, a plurality of terminals 224, a side wall 226*a*, a side wall 226*b*, a jutting section 227*a*, a jutting section 227*b*, a jutting section 228*a*, a jutting section 228*b*, a wall section 229*a*, and a wall section 229*b*.

The terminal holding section 222 of the apparatus side terminal section 220 hold the plurality of terminals 224. The plurality of terminals 224 in the apparatus side terminal section 220 are formed from elastic members which are conductive and protrude from the apparatus side holding section 222. The plurality of terminals 224 are electrically connected due to contact with the substrate 60 by elastically changing shape according to contact with the substrate 60 to accompany the ink cartridge 30 being mounted with regard to the cartridge holder 20.

The side wall 226*a* of the apparatus side terminal section 220 is a wall section along the ZY plane which is provided more to the +X axis direction side than the plurality of terminals 224. The jutting section 227*a* and the jutting section 228*a* of the apparatus side terminal section 220 are convex sections which extend in the Y axis direction so as to protrude from the side wall 226*a* in the +X axis direction. The jutting section 227*a* and the jutting section 228*a* form a groove which extends in the Y axis direction between the jutting section 227*a* and the jutting section 228*a*. The jutting section 227*a* configures a first apparatus side fastening surface which extends in the Y axis direction toward the +Z axis direction and engages with the substrate holder 50. In the present embodiment, the +Y axis direction side of the jutting section 227*a* is inclined in the −Z axis direction and the +Y axis direction side of the jutting section 228*a* is inclined in the +Z axis direction. The wall section 229*a* of the apparatus side terminal section 220 is a wall surface along the ZX plane which is provided on the −Y axis direction side of the jutting section 227*a* and the jutting section 228*a* and which protrudes from the side wall 226*a* in the +X axis direction.

The side wall 226*b* of the apparatus side terminal section 220 is a wall section along the ZY plane which is provided more to the −X axis direction side than the plurality of terminals 224. The jutting section 227*b* and the jutting section 228*b* of the apparatus side terminal section 220 are convex sections which extend in the Y axis direction so as to protrude from the side wall 226*b* in the −X axis direction. The jutting section 227*b* and the jutting section 228*b* form a groove which extends in the Y axis direction between the jutting section 227*b* and the jutting section 228*b*. The jutting section 227*b* configures a second apparatus side fastening surface which extends in the Y axis direction toward the +Z axis direction and engages with the substrate holder 50. In the present embodiment, the +Y axis direction side of the jutting section 227*b* is inclined in the −Z axis direction and the +Y axis direction side of the jutting section 228*b* is inclined in the +Z axis direction. The wall section 229*b* of the apparatus side terminal section 220 is a wall surface along the ZX plane which is provided on the −Y axis direction side of the jutting section 227*b* and the jutting section 228*b* and which protrudes from the side wall 226*b* in the +X axis direction.

In the apparatus side terminal section 220, the side wall 226*a* prevents positional deviation of the substrate holder 50 in the −X axis direction and the side wall 226*b* prevents positional deviation of the substrate holder 50 in the +X axis direction. The jutting section 227*a* and the jutting section 227*b* prevent positional deviation of the substrate holder 50 in the −Z axis direction. The jutting section 228*a* and the jutting section 228*b* prevent positional deviation of the substrate holder 50 in the +Z axis direction. The wall section 229*a* and the wall section 229*b* prevent positional deviation of the substrate holder 50 in the −Y axis direction.

Figure 7:
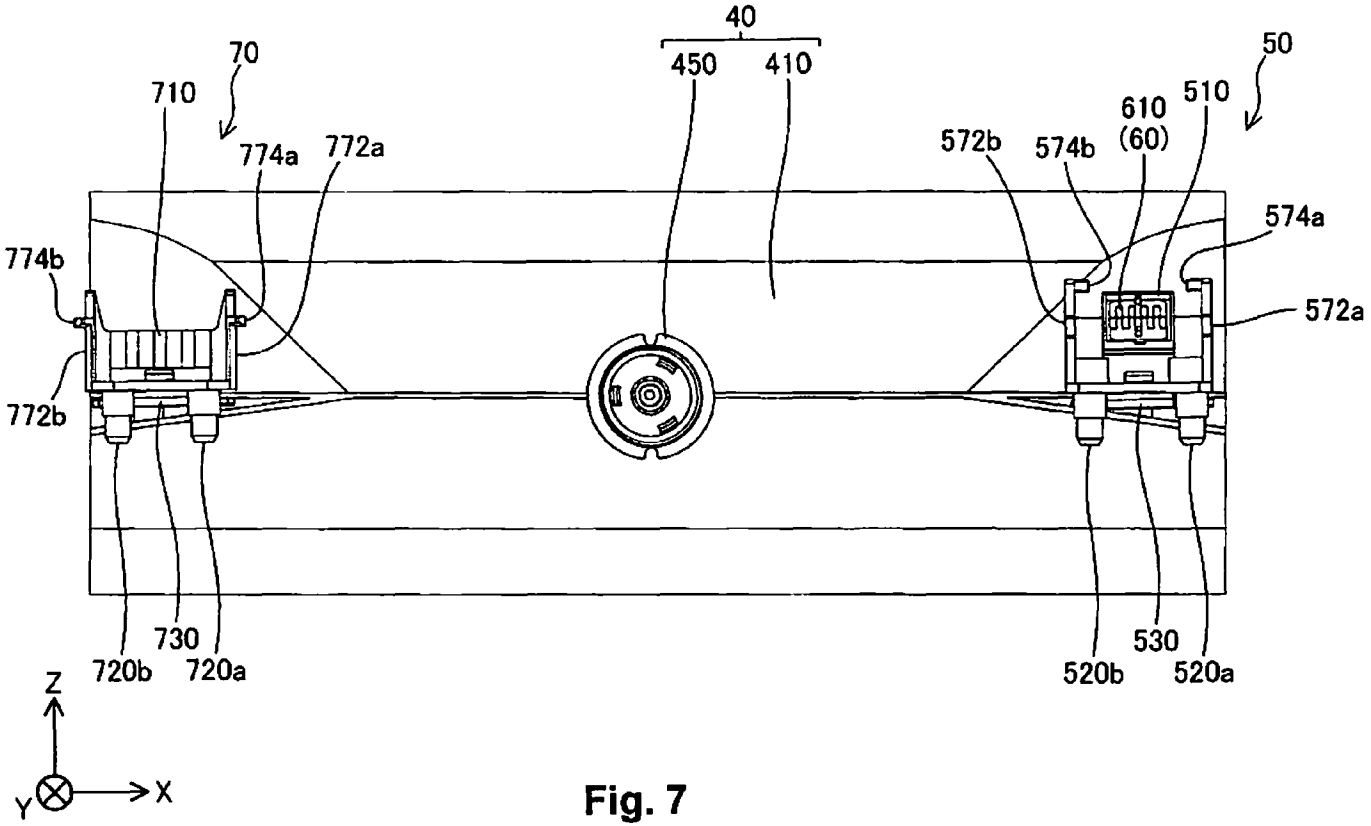
FIG. 7 is an explanatory diagram illustrating an ink pack viewed from the −Y axis direction.
Figure 8:
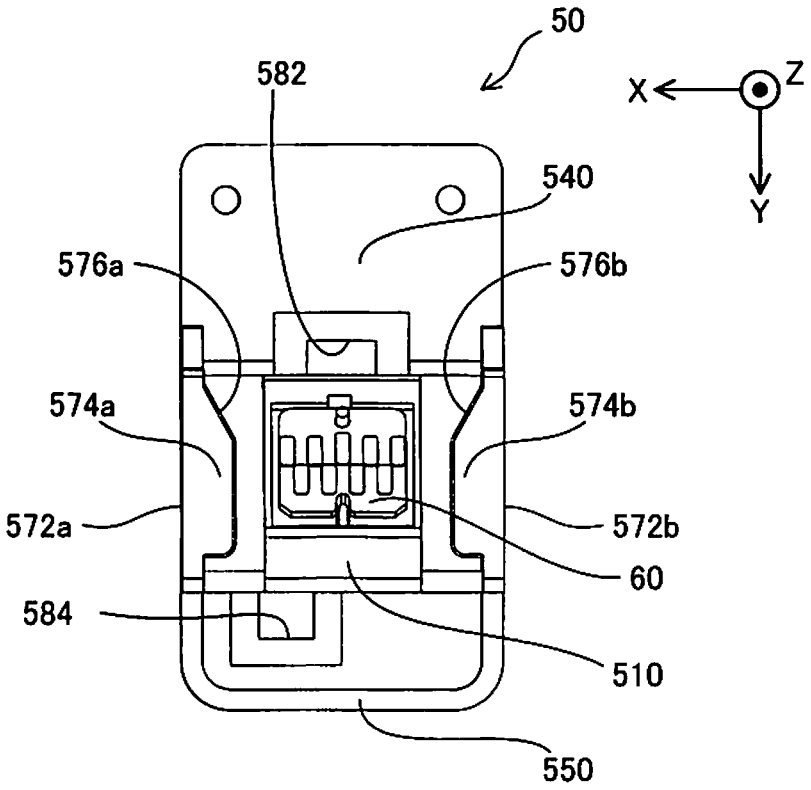
FIG. 8 is an explanatory diagram illustrating a substrate holder viewed from the +Z axis direction.
Figure 9:
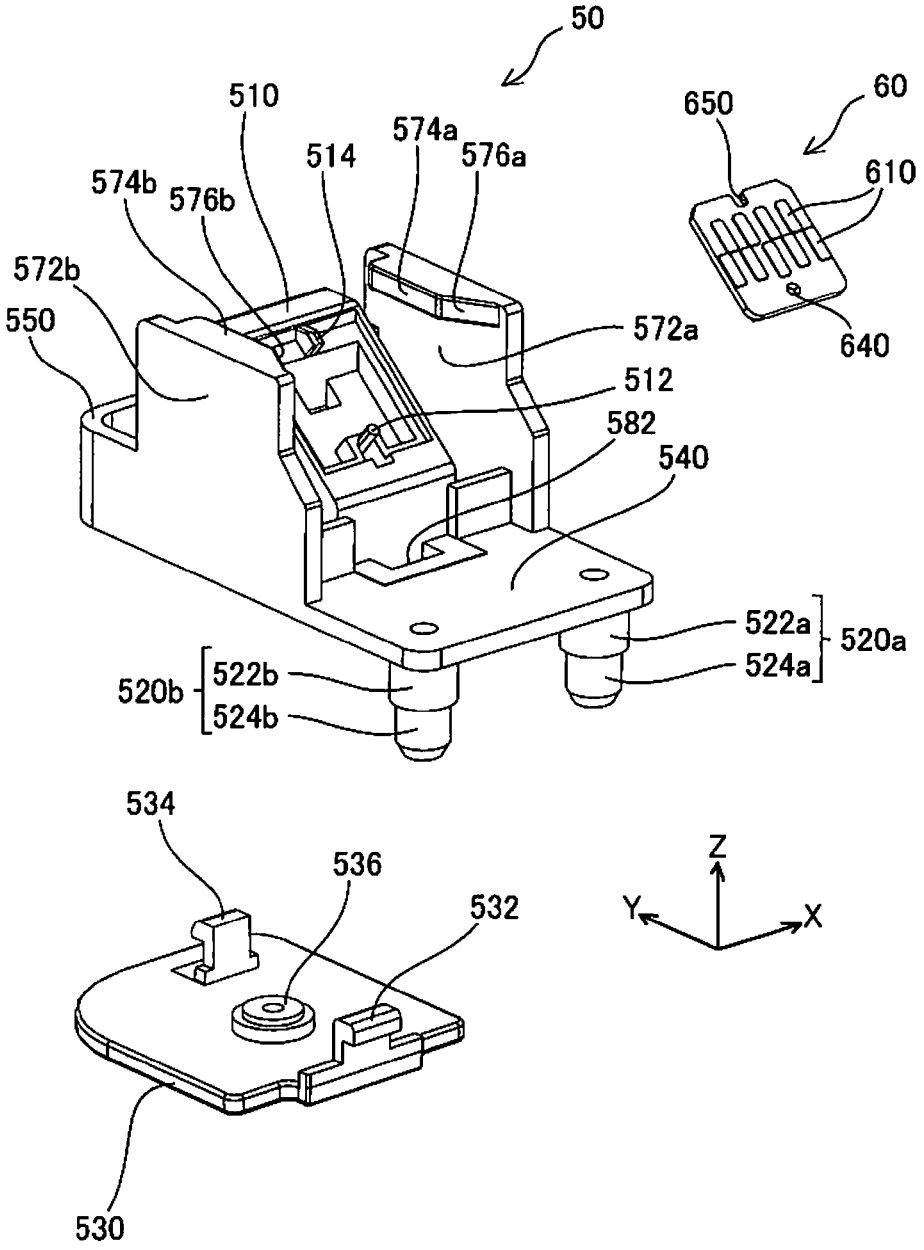
FIG. 9 is an exploded perspective diagram illustrating a substrate holder.
Figure 10:
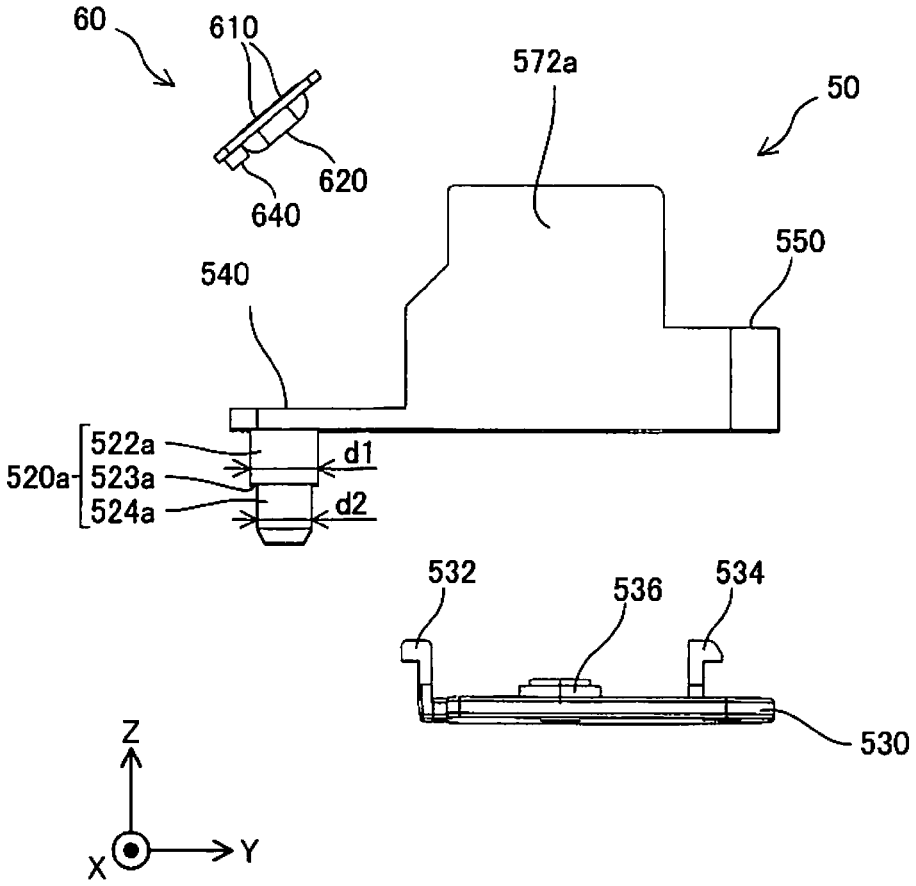
FIG. 10 is an exploded diagram illustrating a substrate holder viewed from the +X axis direction.

FIG. 7 is an explanatory diagram illustrating the ink pack 40 viewed from the −Y axis direction. FIG. 8 is an explanatory diagram illustrating the substrate holder 50 viewed from the +Z axis direction. FIG. 9 is an exploded perspective diagram illustrating the substrate holder 50. FIG. 10 is an exploded diagram illustrating the substrate holder 50 viewed from the +X axis direction. The substrate holder 50 further has a side wall 572*a*, a side wall 572*b*, a jutting section 574*a*, and a jutting section 574*b*.

The side wall 572*a* of the substrate holder 50 is a first side wall along the YZ plane which is provided more to the +X axis direction side than the substrate holding section 510. The jutting section 574*a* of the substrate holder 50 is a first jutting section which extends in the Y axis direction so as to protrude from the side wall 572*a* in the −X axis direction. The jutting section 574*a* engages with the jutting section 227*a* of the apparatus side terminal section 220 to accompany the ink cartridge 30 being mounted with regard to the cartridge holder 20. In the present embodiment, an inclined surface 576*a* which faces the −X axis direction and the −Y axis direction is formed on the −Y axis direction side in the jutting section 574*a*.

The side wall 572*b* of the substrate holder 50 is a second side wall along the YZ plane which opposes the side wall 572*a* and which is provided more to the −X axis direction side than the substrate holding section 510. The jutting section 574*b* of the substrate holder 50 is a second jutting section which extends in the Y axis direction so as to protrude from the side wall 572*a* in the +X axis direction. The jutting section 574*b* engages with the jutting section 227*b* of the apparatus side terminal section 220 to accompany the ink cartridge 30 being mounted with regard to the cartridge holder 20. In the present embodiment, an inclined surface 576*b* which faces the +X axis direction and the −Y axis direction is formed on the −Y axis direction side in the jutting section 574*b*.

As shown in FIG. 7, the side wall 572*a* and the side wall 572*b* are shifted from the contact section 610 of the substrate 60 in the Z axis direction. In the embodiment, the side wall 572*a* and the side wall 572*b* are shifted from the contact section 610 in the +Z axis direction.

As shown in FIG. 9, the substrate holding section 510 of the substrate holder 50 has a protuberance 512 and a protuberance 514. The protuberance 512 of the substrate holding section 510 positionally aligns the −Z axis direction side of the substrate 60 by being inserted into a through hole 640 which is formed in the substrate 60. The protuberance 514 of the substrate holding section 510 positionally aligns the +Z axis direction side of the substrate 60 by fitting into a cutting 650 which is formed in the substrate 60.

As shown in FIG. 9 and FIG. 10, the substrate 60 has a plurality of contact sections 610 and a storage apparatus 620. The plurality of contact sections 610 in the substrate 60 are a plurality of electrodes which are formed from a conductive material. At least one of the plurality of contact sections 610 is electrically connected with the storage apparatus 620. The plurality of contact sections 610 face the −Y axis direction and the +Z axis direction in a state where the substrate 60 is held by the substrate holding section 510. The plurality of contact sections 610 are electrically connected due to contact with the plurality of terminals 224 in the apparatus side terminal section 220 to accompany the ink cartridge 30 being mounted with regard to the cartridge holder 20. The storage apparatus 620 of the substrate 60 stores information related to UV ink which is contained in the ink pack 40. In the present embodiment, the storage apparatus 620 is a semiconductor memory.

As shown in FIG. 7, FIG. 9, and FIG. 10, there is a plurality of the engaging sections 520 in the substrate holder 50. In the present embodiment, the substrate holder 50 is provided with an engaging section 520*a* and an engaging section 520*b* as two of the engaging sections 520. In the explanation of the present embodiment, the reference numeral "520" is used in cases where both of the two engaging sections in the substrate holder 50 are being referred to and the reference numeral "520*a*" and the reference numeral "520*b*" are used in cases where the two respective engaging sections in the substrate holder 50 are being specified individually.

The engaging section 520*a* of the substrate holder 50 is positioned on the +X axis direction side in the substrate holder 50. In the present embodiment, the engaging section 520*a* has a protruding section 522*a* and a protruding section 524*a*. The protruding section 522*a* is a first protruding section which protrudes in the −Z axis direction and the protruding section 524*a* is a second protruding section which protrudes further in the −Z axis direction from the protruding section 522*a*. A diameter d1 of the protruding section 522*a* is larger than a diameter d2 of the protruding section 524*a*. That is, the protruding section 524*a* is thinner than the protruding section 522*a*. The protruding section 522*a* has a surface 523*a* which is formed due to the differences in diameter with the protruding section 524*a*. The surface 523*a* of the protruding section 522*a* is a surface which faces the −Z axis direction. The protruding section 522*a* functions as a positional aligning section which determines the position of the substrate holder 50 with regard to the ink cartridge 30 in the Z axis direction due to contacting with regard to the wall section 334 of the platform member 330 in the ink cartridge 30 at the surface 523*a* from the +Z axis direction. The protruding section 524*a* passes through the wall section 334 of the platform member 330 in the ink cartridge 30.

The engaging section 520*b* of the substrate holder 50 is positioned on the −X axis direction side in the substrate holder 50. In the present embodiment, the engaging section 520*b* has a protruding section 522*b* and a protruding section 524*b*. The protruding section 522*b* of the engaging section 520*b* is the same as the protruding section 522*a* of the engaging section 520*a*, and protruding section 524*b* of the engaging section 524*b* is the same as the protruding section 524*b* of the engaging section 520*a*.

As shown in FIG. 9 and FIG. 10, the engaging section 530 of the substrate holder 50 has a fastening section 532, a fastening section 534, and a protruding section 536. The fastening section 532 of the engaging section 530 is provided on the −Y axis direction side of the engaging section 530 and is clasped by engaging with an opening 582 which is formed in the substrate holding section 510. Due to this, the −Y axis direction side of the engaging section 530 is fixed to the substrate holding section 510. The fastening section 534 of the engaging section 530 is provided on the +Y axis direction side of the engaging section 530 and is clasped by engaging with an opening 584 which is formed in the substrate holding section 510. Due to this, the +Y axis direction side of the engaging section 530 is fixed to the substrate holding section 510. The protruding section 536 of the engaging section 530 determines the position of the substrate holder 50 with regard to the ink pack 40 by engaging with the ink pack 40.

Figure 11:
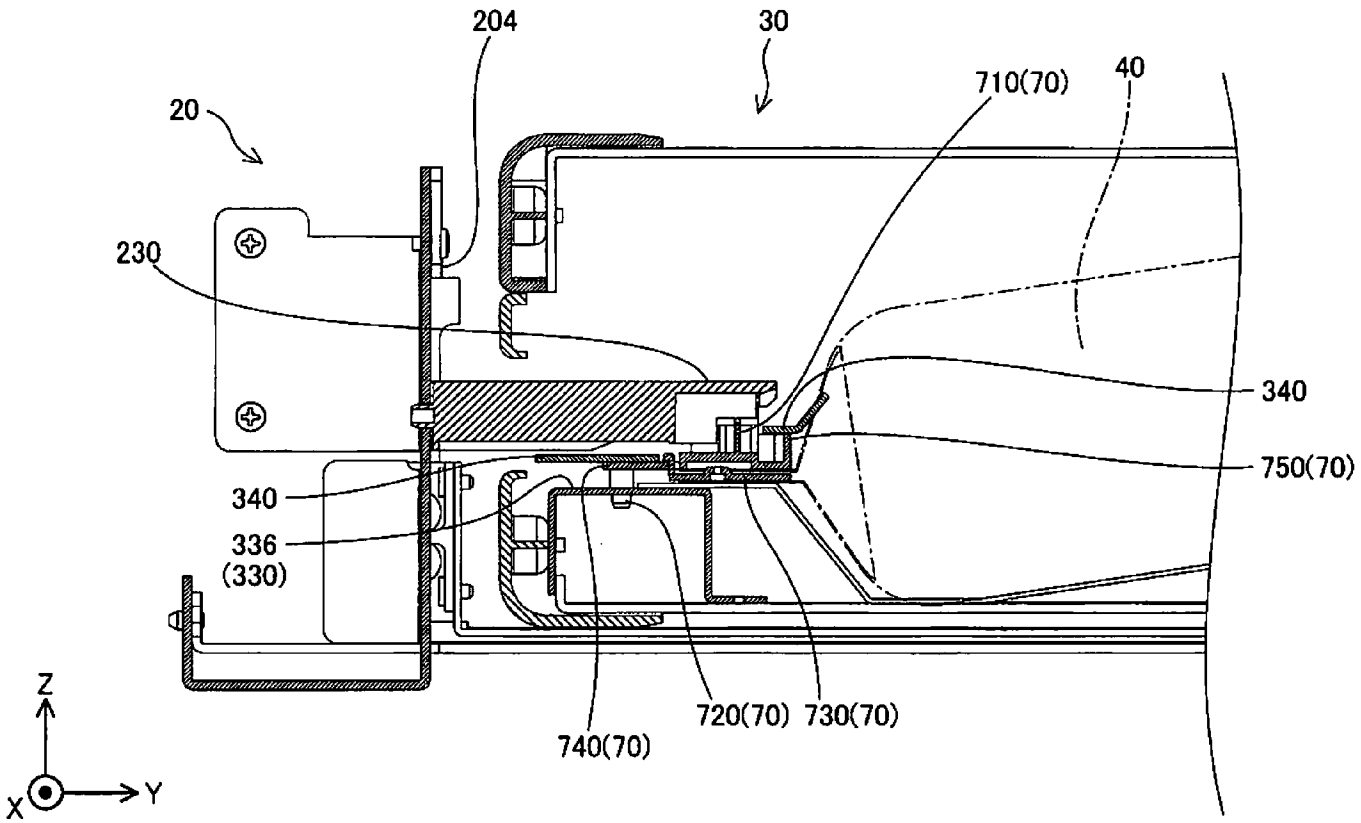
FIG. 11 is a cross sectional diagram illustrating a cartridge holder in which an ink cartridge is mounted.

FIG. 11 is a cross sectional diagram illustrating the cartridge holder 20 in which the ink cartridge 30 is mounted. The cross sectional diagram of FIG. 11 is a diagram of the cartridge holder 20 in which the ink cartridge 30 is mounted where a cross section, which is cut along the YZ plane at a position to pass through the apparatus side identifying section 230, is viewed from the +X axis direction. The ink cartridge 30 is further provided with an identifier holder 70.

The identifier holder 70 is an additional member which is added to the ink pack 40. In the present embodiment, the identifier holder 70 supports an identifier which indicates the color of UV ink which is contained in the ink pack 40. The identifier of the identifier holder 70 indicates the color of UV ink which is contained in the ink pack 40 using differences in shapes according to rows and the presence and absence of protuberances. The apparatus side identifying section 230 detects the shape of the identifier in the identifier holder 70 due to contact with the identifier holder 70 to accompany the ink cartridge 30 being mounted with regard to the cartridge holder 20. The printing apparatus 10 identifies the color of UV ink which is contained in the ink pack 40 based on the shape of the identifier which is detected by the apparatus side identifying section 230.

The identifier holder 70 has an identifier forming section 710, an engaging section 720, an engaging section 730, a pressed section 740, and a pressed section 750. The identifier forming section 710 of the identifier holder 70 is a part where the identifier which indicates the color of UV ink is formed. In the present embodiment, the identifier in the identifier holder 70 is formed at a position which overlaps with the substrate 60 in the Y axis direction.

The engaging section 720 of the identifier holder 70 is a third engaging section which engages with regard to the platform member 330 of the ink cartridge 30 from the +Z axis direction side at a position in the substrate holder 50 more to the −Y axis direction side than the substrate 60. In the present embodiment, the platform member 330 has a wall section 336 along the XY plane and the engaging section 720 positionally aligns the +Z axis direction side of the wall section 336.

The engaging section 730 of the identifier holder 70 is a fourth engaging section which is provided in the substrate holder 50 more to the −Z axis direction side than the substrate 60 and which engages with the ink pack 40 at a position in the substrate holder 50 more to the +Y axis direction side than the substrate 60. In the present embodiment, the engaging section 730 engages with the liquid containing section 410 of the ink pack 40 across from a position which overlaps with the substrate 60 in the Y axis direction to a position more to the +Y axis direction side than the substrate 60. In the present embodiment, the identifier forming section 710 and the engaging section 730 are two separate members, and the liquid containing section 410 of the ink pack 40 is interposed by the identifier forming section 710 and the engaging section 730.

The pressed section 740 of the identifier holder 70 is a third pressed section which receives a third pressing force which includes components in the −Z axis direction at a position in the substrate holder 50 more to the −Y axis direction side than the substrate 60. In the present embodiment, the pressed section 740 is pushed in the −Z axis direction by the pressing member 340 of the ink cartridge 30.

The pressed section 750 of the identifier holder 70 is a fourth pressed section which receives a fourth pressing force which includes components in the −Z axis direction at a position in the substrate holder 50 more to the +Y axis direction side than the substrate 60. In the present embodiment, the pressed section 750 is pushed in the −Z axis direction by the pressing member 340 of the ink cartridge 30. In the present embodiment, the pressed section 750 receives the fourth pressing force at a position more to the +Z axis direction side than the position where the pressed section 740 receives the third pressing force. That is, the pressed section 750 is pushed in the −Z axis direction by the pressing member 340 at a position more to the +Z axis direction side than a position where the pressed section 740 is pushed in the −Z axis direction by the pressing member 340.

Figure 12:
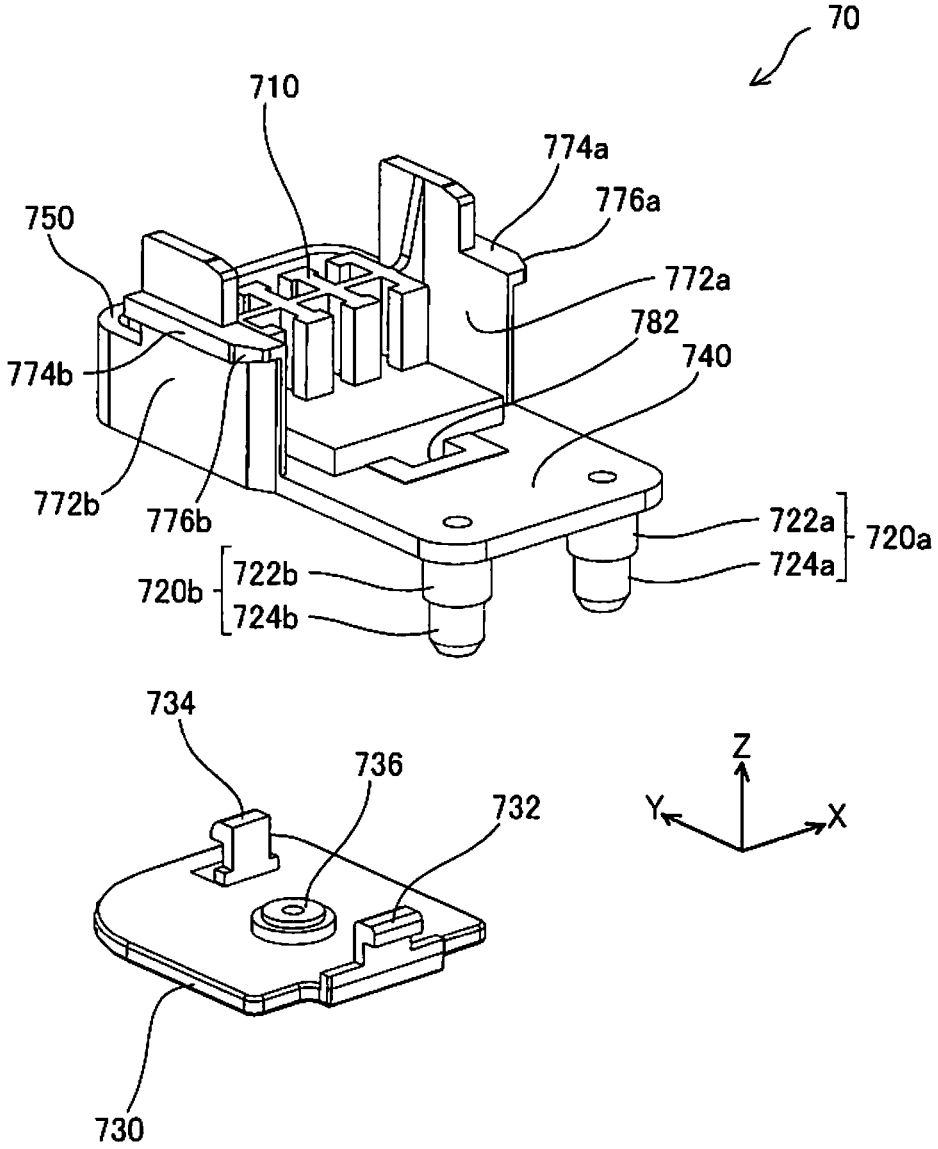
FIG. 12 is an exploded perspective diagram illustrating an identifier holder.

FIG. 12 is an exploded perspective diagram illustrating the identifier holder 70. As shown in FIG. 7 and FIG. 12, the identifier holder 70 further has a side wall 772*a*, a side wall 772*b*, a jutting section 774*a*, and a jutting section 774*b*.

The side wall 772*a* of the identifier holder 70 is a part along the YZ plane which is provided more to the +X axis direction side than the identifier forming section 710. The jutting section 774*a* of the identifier holder 70 is a part which extends in the Y axis direction so as to protrude from the side wall 772*a* in the +X axis direction. The jutting section 774*a* engages with the apparatus side identifying section 230 to accompany the ink cartridge 30 being mounted with regard to the cartridge holder 20. In the present embodiment, an inclined surface 776*a* which faces the +X axis direction and the −Y axis direction is formed on the −Y axis direction side in the jutting section 774*a*.

The side wall 772*b* of the identifier holder 70 is a part along the YZ plane which is provided more to the −X axis direction side than the identifier forming section 710. The jutting section 774*b* of the identifier holder 70 is a part which extends in the Y axis direction so as to protrude from the side wall 772*b* in the −X axis direction. The jutting section 774*b* engages with the apparatus side identifying section 230 to accompany the ink cartridge 30 being mounted with regard to the cartridge holder 20. In the present embodiment, an inclined surface 776*b* which faces the −X axis direction and the −Y axis direction is formed on the −Y axis direction side in the jutting section 774*b*.

There is a plurality of the engaging sections 720 in the identifier holder 70. In the present embodiment, the identifier holder 70 is provided with an engaging section 720*a* and an engaging section 720*b* as two of the engaging sections 720. In the explanation of the present embodiment, the reference numeral "720" is used in cases where both of the two engaging sections in the identifier holder 70 are being referred to and the reference numeral "720*a*" and the reference numeral "720*b*" are used in cases where the two respective engaging sections in the identifier holder 70 are being specified individually.

The engaging section 720*a* of the identifier holder 70 is positioned on the +X axis direction side in the identifier holder 70. In the present embodiment, the engaging section 720*a* has a protruding section 722*a* and a protruding section 724*a*. The protruding section 722*a* and protruding section 724*a* of the engaging section 720*a* in the identifier holder 70 are the same as the protruding section 522*a* and the protruding section 524*a* of the engaging section 520*a* in the substrate holder 50.

The engaging section 720*b* of the identifier holder 70 is positioned on the −X axis direction side in the identifier holder 70. In the present embodiment, the engaging section 720*b* has a protruding section 722*b* and a protruding section 724*b*. The protruding section 722*b* and protruding section 724*b* of the engaging section 720*b* in the identifier holder 70 are the same as the protruding section 522*b* and the protruding section 524*b* of the engaging section 520*b* in the substrate holder 50.

The engaging section 730 of the identifier holder 70 has a fastening section 732, a fastening section 734, and a protruding section 736. The fastening section 732 of the engaging section 730 is provided on the −Y axis direction side of the engaging section 730 and is clasped by engaging with an opening 782 which is formed in the identifier forming section 710. Due to this, the −Y axis direction side of the engaging section 730 is fixed to the identifier forming section 710. The fastening section 734 of the engaging section 730 is provided on the +Y axis direction side of the engaging section 730 and is clasped by engaging with an opening (which is not shown in the diagram) which is formed in the identifier forming section 710. Due to this, the +Y axis direction side of the engaging section 730 is fixed to the identifier forming section 710. The protruding section 736 of the engaging section 730 determines the position of the identifier holder 70 with regard to the ink pack 40 by engaging with the ink pack 40.

Figure 13:
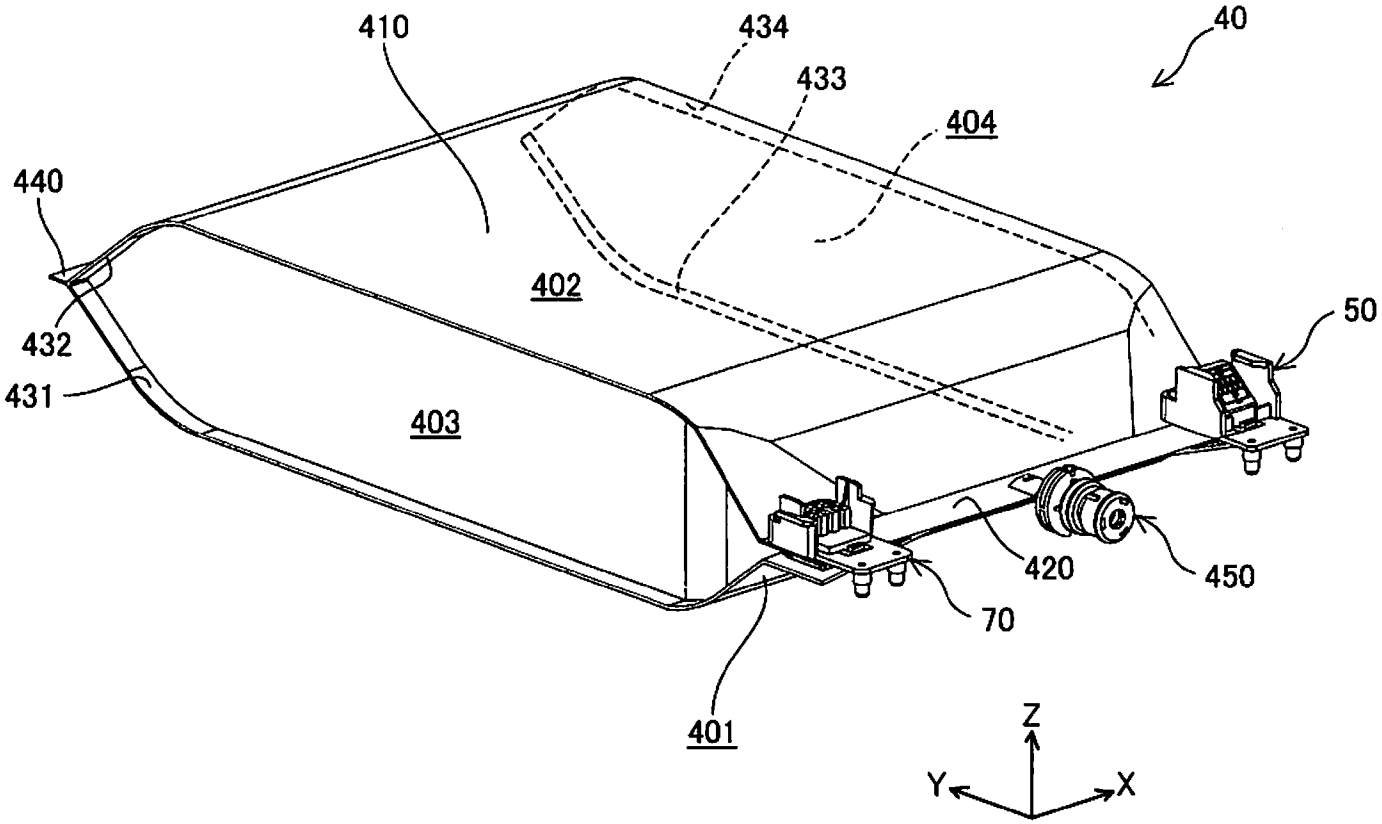
FIG. 13 is a perspective diagram illustrating an ink pack.
Figure 14:
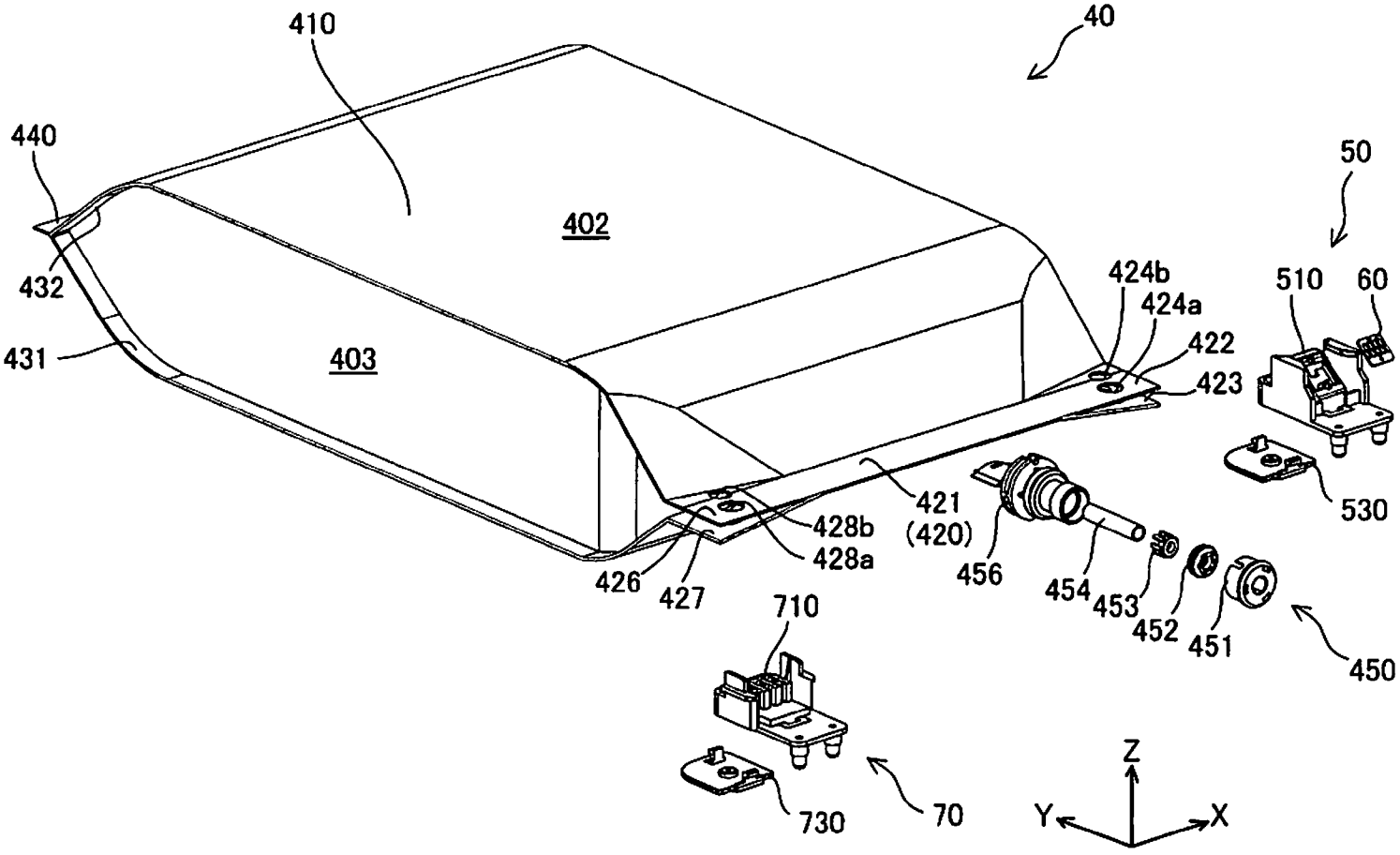
FIG. 14 is an exploded perspective diagram illustrating an ink pack.

FIG. 13 is a perspective diagram illustrating the ink pack 40. FIG. 14 is an exploded perspective diagram illustrating the ink pack 40. The liquid containing section 410 of the ink pack 40 is a part where a flexible member with a thin plate which has flexibility is formed in a bag shape. The flexible member of the liquid containing section 410 blocks ultraviolet rays and visible light in order to prevent deteriorating of UV ink.

In the present embodiment, the liquid containing section 410 is a part where four flexible members 401, 402, 403, and 404 are formed in a bag shape being attached. The flexible members 401 and 402 form a rectangular shape and have a short side along the X axis and a long side along the Y axis. The flexible members 403 and 404 form a rectangular shape and have a short side along the Z axis which is shorter than the short side of the flexible members 401 and 402 and a long side along the Y axis with the same length as the long side of the flexible members 401 and 402.

The flexible member 401 is configured as the flexible wall surface on the −Z axis direction side in the liquid containing section 410. The flexible member 402 is configured as the flexible wall surface on the +Z axis direction side in the liquid containing section 410. The flexible member 403 is configured as the flexible wall surface on the −X axis direction side in the liquid containing section 410. The flexible member 404 is configured as the flexible wall surface on the +X axis direction side in the liquid containing section 410. The liquid inflow section 408 (refer to FIG. 3) which permits inflow of UV ink is formed on the inner sides of the flexible members 401, 402, 403, and 404.

In the present embodiment, the flexible members 401 and 402 are a laminate film where, from the inner side to the outer side, a polyethylene (PE) layer, an adhesive layer, an ethylene-vinyl alcohol copolymer (EVOH) layer, an adhesive layer, a black printing layer, a nylon layer, an adhesive layer, a black printing layer, and a polyethylene terephthalate (PET) layer are laminated. In the present embodiment, the flexible members 403 and 404 are a laminate film where, from the inner side to the outer side, a PE layer, an adhesive layer, an EVOH layer, an adhesive layer, a black printing layer, a nylon layer, an adhesive layer, a black printing layer, and a nylon layer are laminated. In the present embodiment, the thickness of the flexible members 401 and 402 is approximately 0.194 mm and the thickness of the flexible members 403 and 404 is approximately 0.181 mm. In the present embodiment, light absorbency of the flexible members 401, 402, 403, and 404 is 0.00001% to 0.1% (values according to a measurement method based on the Japanese Industrial Standards JIS K 0115:2004) with regard to wavelengths of 200 nm or more and 500 nm or less.

The liquid containing section 410 has a supply side adhering section 420, adhering sections 431, 432, 434, and 433, and an adhering section 440 as adhering section which are formed due to the plurality of flexible wall surfaces being adhered.

The supply side adhering section 420 of the liquid containing section 420 is formed along the X axis on the −Y axis direction side of the liquid containing section 410. The supply side adhering section 420 is spread out over the XY plane. The supply side adhering section 420 configures a first side which is positioned on the −Y axis direction side in the liquid containing section 410. The supply side adhering section 420 has parts 421, 422, 423, 426, and 427.

The part 421 of the supply side adhering section 420 is positioned at the center of the supply side adhering section 420 in the X axis direction. The part 421 is a part which is formed due to adhering of the flexible member 401 and the flexible member 402. The liquid supply member 450 is provided in the part 421. The liquid supply member 450 passes through the part 421 in a state of being interposed between the flexible member 401 and the flexible member 402.

The parts 422 and 423 of the supply side adhering section 420 are positioned on the +X axis direction side in the supply side adhering section 420. The part 422 is a part which is formed due to adhering of the flexible member 402 and the flexible member 404, and the part 423 is a part which is formed due to adhering of the flexible member 401 and the flexible member 404. Through holes 424*a* and 424*b* are provided in the part 422. The substrate holder 50 is attached to the liquid containing section 410 due to the part 422 being interposed between the substrate holding section 510 and the engaging section 530 in a state where the protruding section 536 of the engaging section 530 passes through the through hole 424*a* and the fastening section 534 of the engaging section 530 passes through the through hole 424*b*.

The parts 426 and 427 of the supply side adhering section 420 are positioned on the −X axis direction side of the supply side adhering section 420. The part 426 is a part which is formed due to adhering of the flexible member 402 and the flexible member 403, and the part 427 is a part which is formed due to adhering of the flexible member 401 and the flexible member 403. Through holes 428*a* and 428*b* are provided in the part 426. The identifier holder 70 is attached to the liquid containing section 410 due to the part 426 being interposed between the identifier forming section 710 and the engaging section 730 in a state where the protruding section 736 of the engaging section 730 passes through the through hole 428*a* and the fastening section 734 of the engaging section 730 passes through the through hole 428*b*.

The adhering section 440 of the liquid containing section 410 is formed along the X axis on the +Y axis direction side of the liquid containing section 410. The adhering section 440 is a part which is formed due to adhering of the flexible members 401, 402, 403, and 404. The adhering section 440 configures a second side which opposes the supply side adhering section 420 and which is positioned on the +Y axis direction side of the liquid containing section 410.

The adhering section 431 of the liquid containing section 410 is a part which is formed due to adhering of the flexible member 401 and the flexible member 403, and the adhering section 432 of the liquid containing section 410 is a part which is formed due to adhering of the flexible member 402 and the flexible member 403. The adhering section 431 and the adhering section 432 configure a third side which links the supply side adhering section 420 and the adhering section 440 at the −X axis direction side.

The adhering section 433 of the liquid containing section 410 is a part which is formed due to adhering of the flexible member 401 and the flexible member 404, and the adhering section 434 of the liquid containing section 410 is a part which is formed due to adhering of the flexible member 402 and the flexible member 404. The adhering section 433 and the adhering section 434 configure a fourth side which links the supply side adhering section 420 and the adhering section 440 at the +X axis direction side.

As shown in FIG. 14, in the present embodiment, the liquid supply member 450 of the ink pack 40 is provided with an end section member 451, a sealing member 452, a fixing member 453, a cylindrical member 454, and an outer casing member 456. The end section member 451 of the liquid supply member 450 is attached to the −Y axis direction side of the outer casing member 456, holds the sealing member 452 at an inner side of the outer casing member 456, and guides the liquid supply tube 210 to an inner side of the outer casing member 456. The sealing member 452 of the liquid supply member 450 prevents leaking of UV ink and receives insertion of the liquid supply tube 210. The fixing member 453 of the liquid supply member 450 fixes the cylindrical member 454 at an inner side of the outer casing member 456. The cylindrical member 454 of the liquid supply member 450 forms a flow path in which UV ink flows in an inner side of the outer casing member 456. The outer casing member 456 of the liquid supply member 450 is adhered to the part 421 of the supply side adhering section 420 in the ink pack 40 and holds the other members in the liquid supply member 450.

In the present embodiment, out of the members which configure the liquid supply member 450, at least the end section member 451, the sealing member 452, and the outer casing member 456 are members which are formed of a composite resin which is colored black and blocks ultraviolet rays and visible light. In the present embodiment, the composite resin which is used in the end section member 451 and the outer casing member 456 is polyethylene (PE) where black masterbatch ("TET OCA 041 Black" manufactured by Toyo Color Co. Ltd.) with 3 to 5 mass % is added. In the present embodiment, light absorbency of the end section member 451 and the outer casing member 456 is 0.00001% to 0.1% (values according to a measurement method based on the Japanese Industrial Standards JIS K 0115:2004) with regard to wavelengths of 200 nm or more and 500 nm or less.

In the present embodiment, in a state where the ink pack 40 is contained in the ink cartridge 30, the end section member 451 of the liquid supply member 450 is positioned on the +Z axis direction side in the regulating section 331 of the platform member 330 and the outer casing member 456 of the liquid supply member 450 is positioned on the +Z axis direction side in the regulating section 332 of the platform member 330. In the present embodiment, in a state where the ink pack 40 is contained in the ink cartridge 30, the end section member 451 of the liquid supply member 450 is a third pressed section which receives a third pressing force which includes components in the −Z axis direction. In the present embodiment, the end section member 451 is pushed in the −Z axis direction by the pressing member 340 of the ink cartridge 30.

Figure 15A:
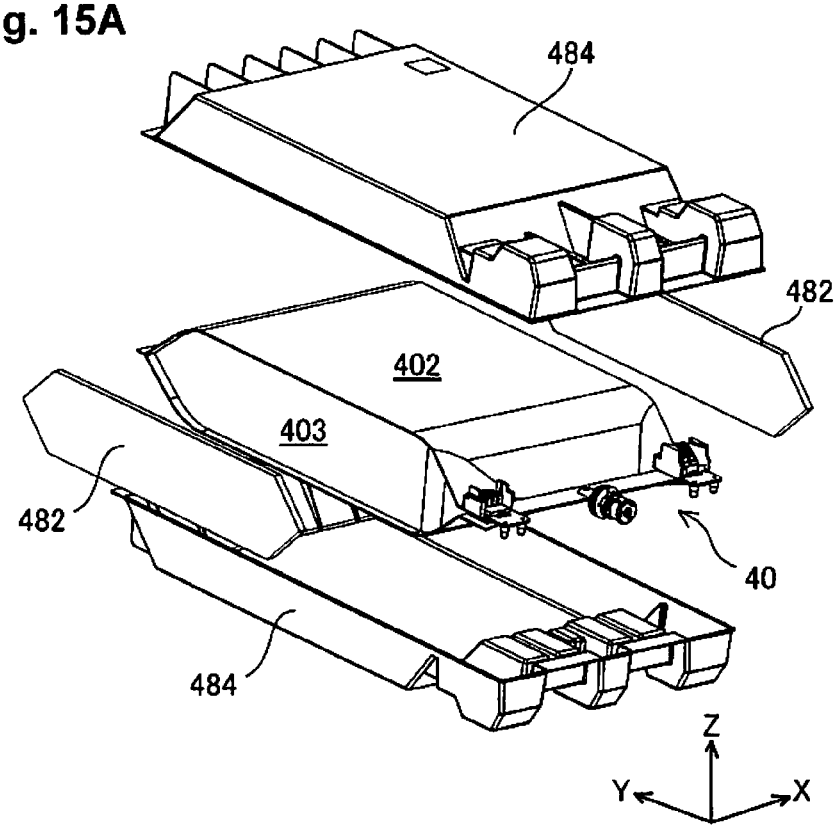
FIGS. 15A and 15B are explanatory diagrams illustrating a process where an ink pack is packaged.
Figure 15B:
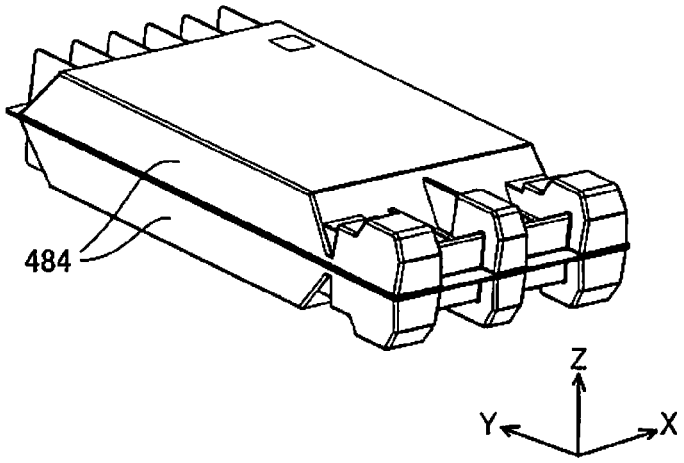

FIGS. 15A and 15B are explanatory diagrams illustrating a process where the ink pack 40 is packaged. The manufacturer of the ink pack 40 houses the ink pack 40 in two protective cases 484 after the ink pack 40 is manufactured up to the state which is shown in FIG. 13. FIG. 15A shows a state before the ink pack 40 is housed in the two protective cases 484. FIG. 15B shows a state where the ink pack 40 is housed in the two protective cases 484.

In the present embodiment, a plate member 482 which has a thickness according to the width of the adhering sections 431, 432, 433, and 434 is added in the flexible members 403 and 404 in the ink pack 40 in order to prevent the ink pack 40 from changing shape. In the present embodiment, the plate member 482 is made of cardboard.

In the present embodiment, the two protective cases 484 are members which are formed of a composite resin which is colored black and blocks ultraviolet rays and visible light. In the present embodiment, the composite resin which is used in the two protective cases 484 is polyethylene (PE) where black masterbatch ("TET OCA 041 Black" manufactured by Toyo Color Co. Ltd.) with 3 to 5 mass % is added. In the present embodiment, light absorbency of the two protective cases 484 is 0.00001% to 0.1% (values according to a measurement method based on the Japanese Industrial Standards JIS K 0115:2004) with regard to wavelengths of 200 nm or more and 500 nm or less.

In the present embodiment, the two protective cases 484 are formed in a tray shape which is spread out over the XY plane. In the present embodiment, the two protective cases 484 have the same shape.

In the present embodiment, out of the two protective cases 484, one of the protective cases 484 covers the flexible member 402 of the ink pack 40 from the +Z axis direction and the other of the protective cases 484 covers the flexible member 403 of the ink pack 40 from the −Z axis direction. Due to this, it is possible for blocking of light with regard to the ink pack 40 to be improved since it is possible to cover the flexible members 402 and 403 which are relatively large parts in the ink pack 40.

Figure 16A:
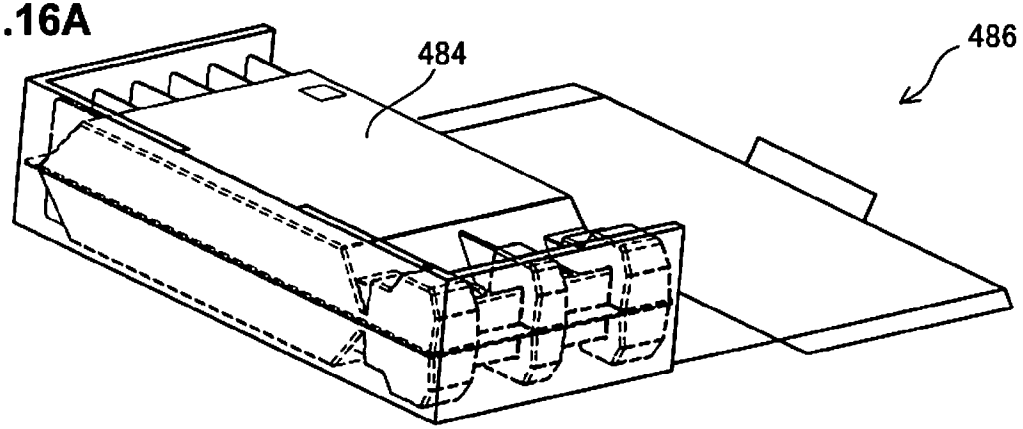
FIGS. 16A and 16B are explanatory diagrams illustrating a process where an ink pack is packaged.
Figure 16B:
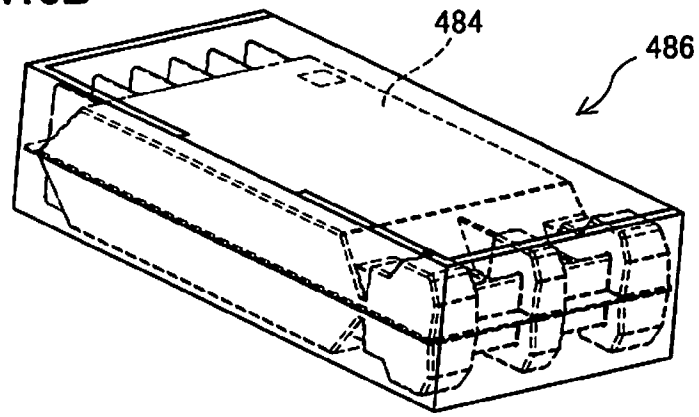

FIGS. 16A and 16B are explanatory diagrams illustrating a process where the ink pack 40 is packaged. The manufacturer of the ink pack 40 houses the ink pack 40 which is contained in the two protective cases 484 in a packaging box 486 after the ink pack 40 is housed in the two protective cases 484 as shown in FIGS. 15A and 15B. FIG. 16A shows a state where the packaging box 486 is open. FIG. 16B shows a state where the packaging box 486 is closed. In the present embodiment, the packaging box 486 is made of cardboard.

The user of the printing apparatus 10 removes the ink pack 40 which is contained in the two protective cases 484 from the packaging box 486 when the ink pack 40 is to be used. After this, the user removes the ink pack 40 from the two protective cases 484.

Figure 17:
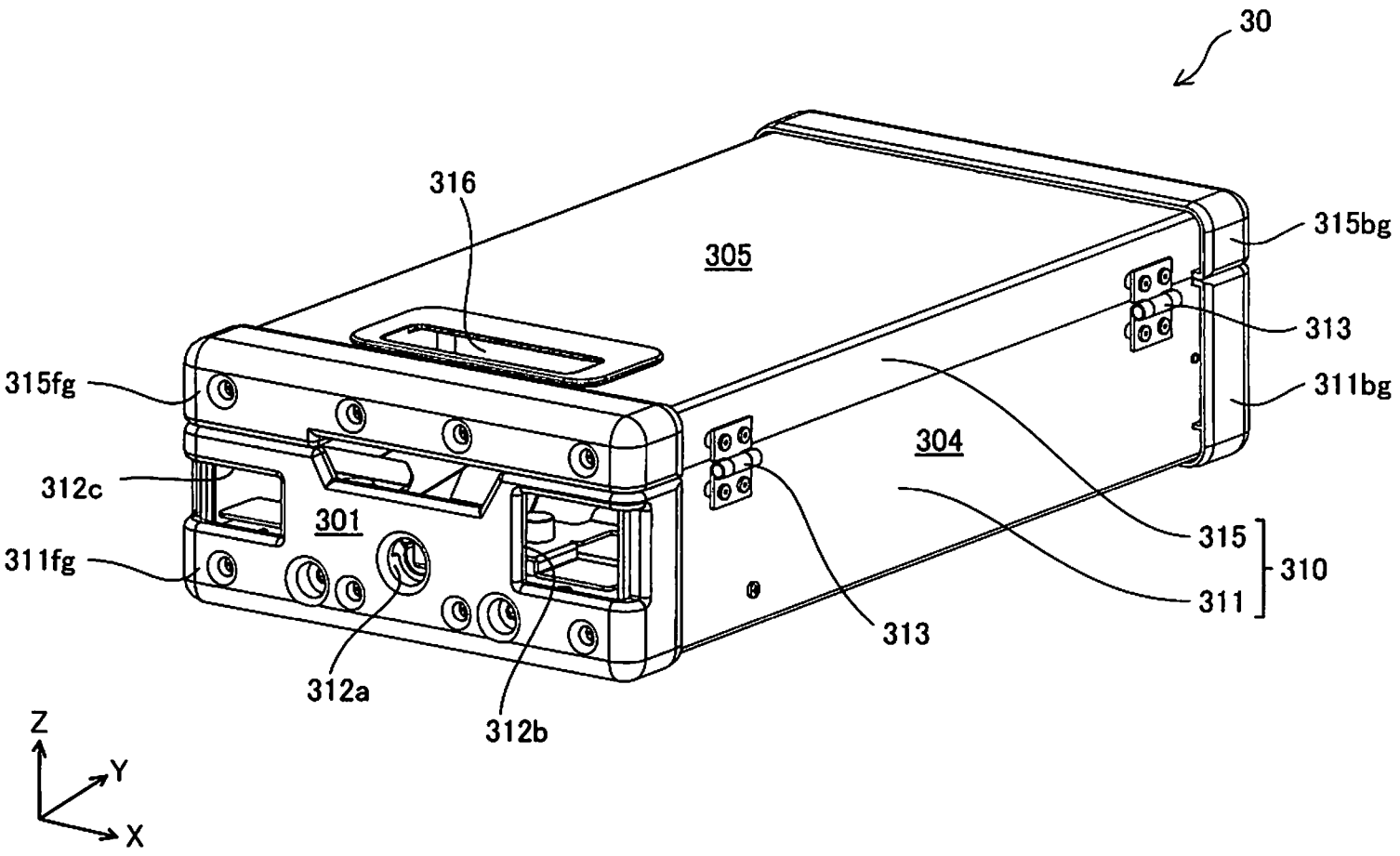
FIG. 17 is a perspective diagram illustrating an ink cartridge viewed from a rear surface side.
Figure 18:
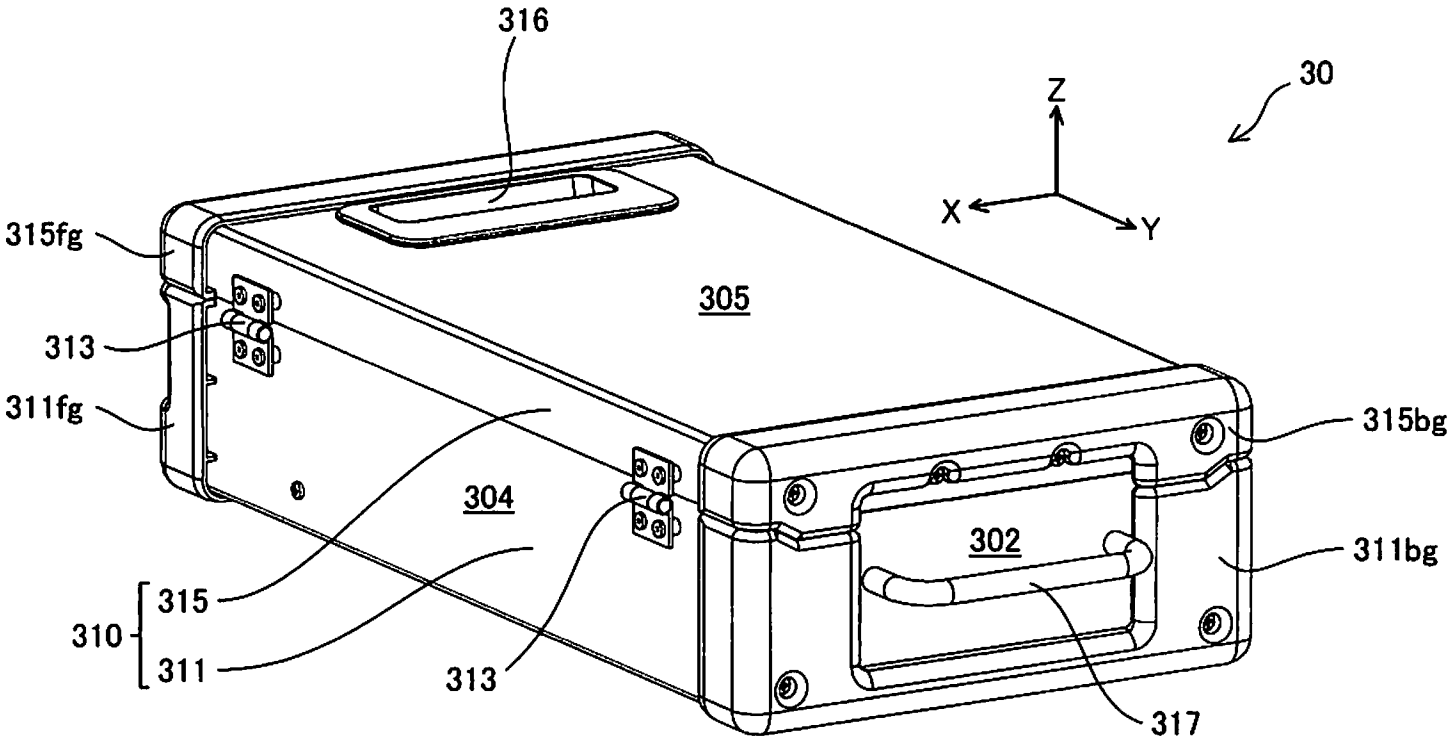
FIG. 18 is a perspective diagram illustrating an ink cartridge viewed from a front surface side.
Figure 19:
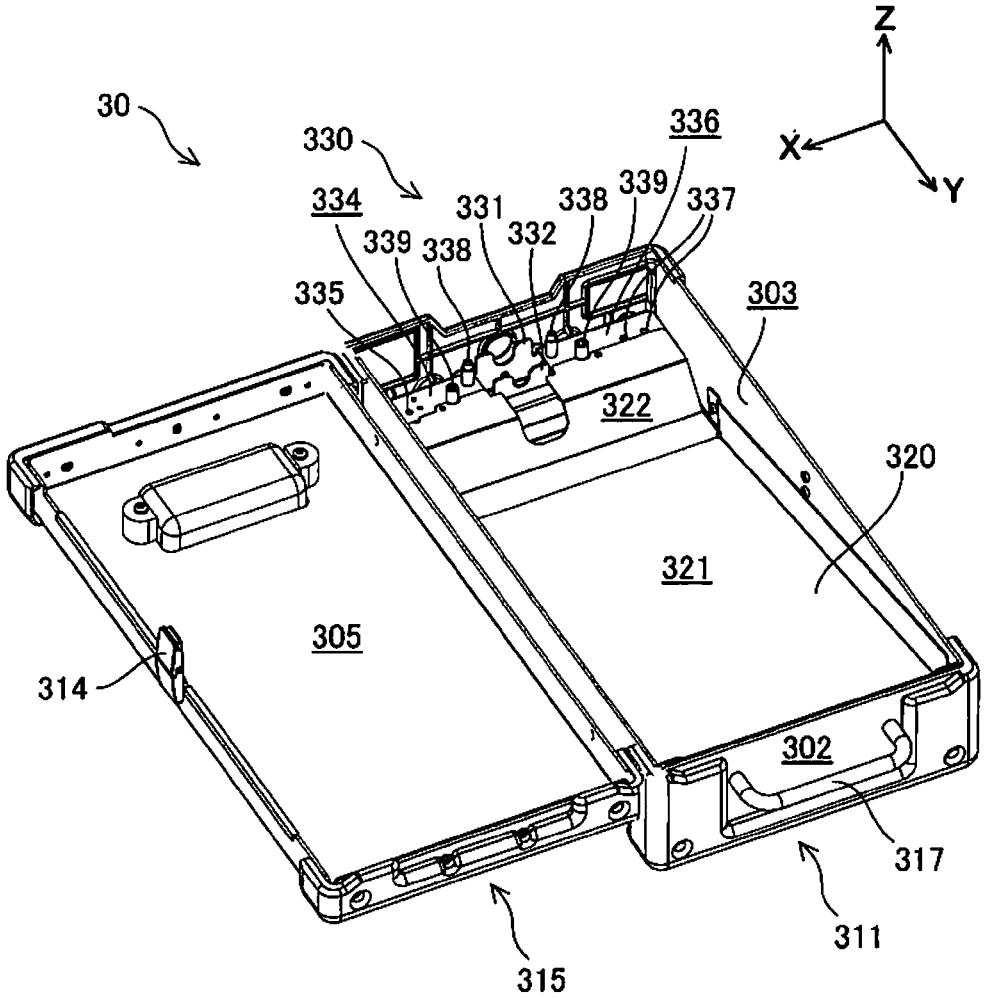
FIG. 19 is a perspective diagram illustrating an ink cartridge in a state of being open.

FIG. 17 is a perspective diagram illustrating the ink cartridge 30 viewed from a rear surface side. FIG. 18 is a perspective diagram illustrating the ink cartridge 30 viewed from a front surface side. FIG. 19 is a perspective diagram illustrating the ink cartridge 30 in a state of being open.

Figure 20:
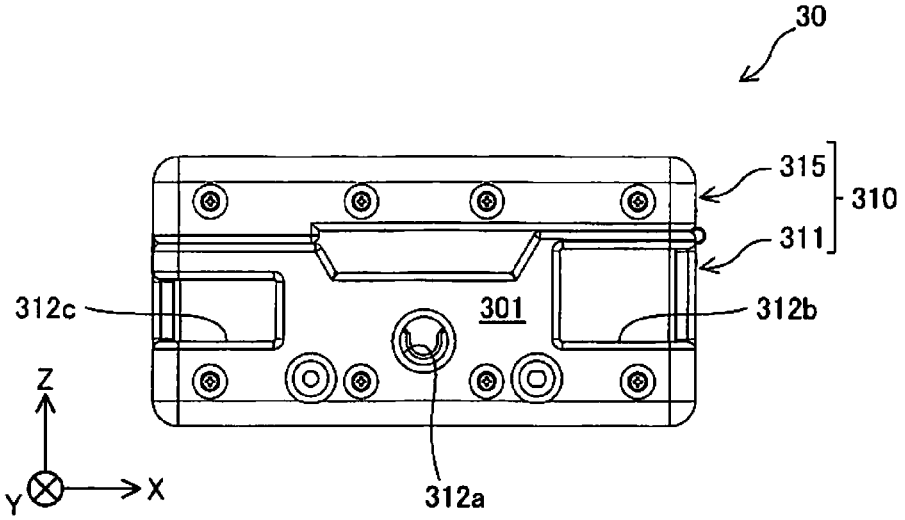
FIG. 20 is a rear surface diagram of an ink cartridge.
Figure 21:
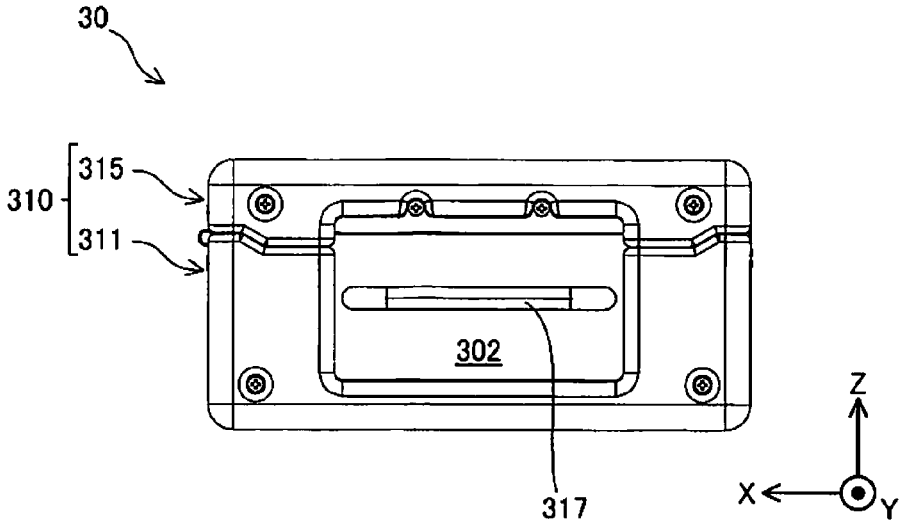
FIG. 21 is a front surface diagram of an ink cartridge.
Figure 22:
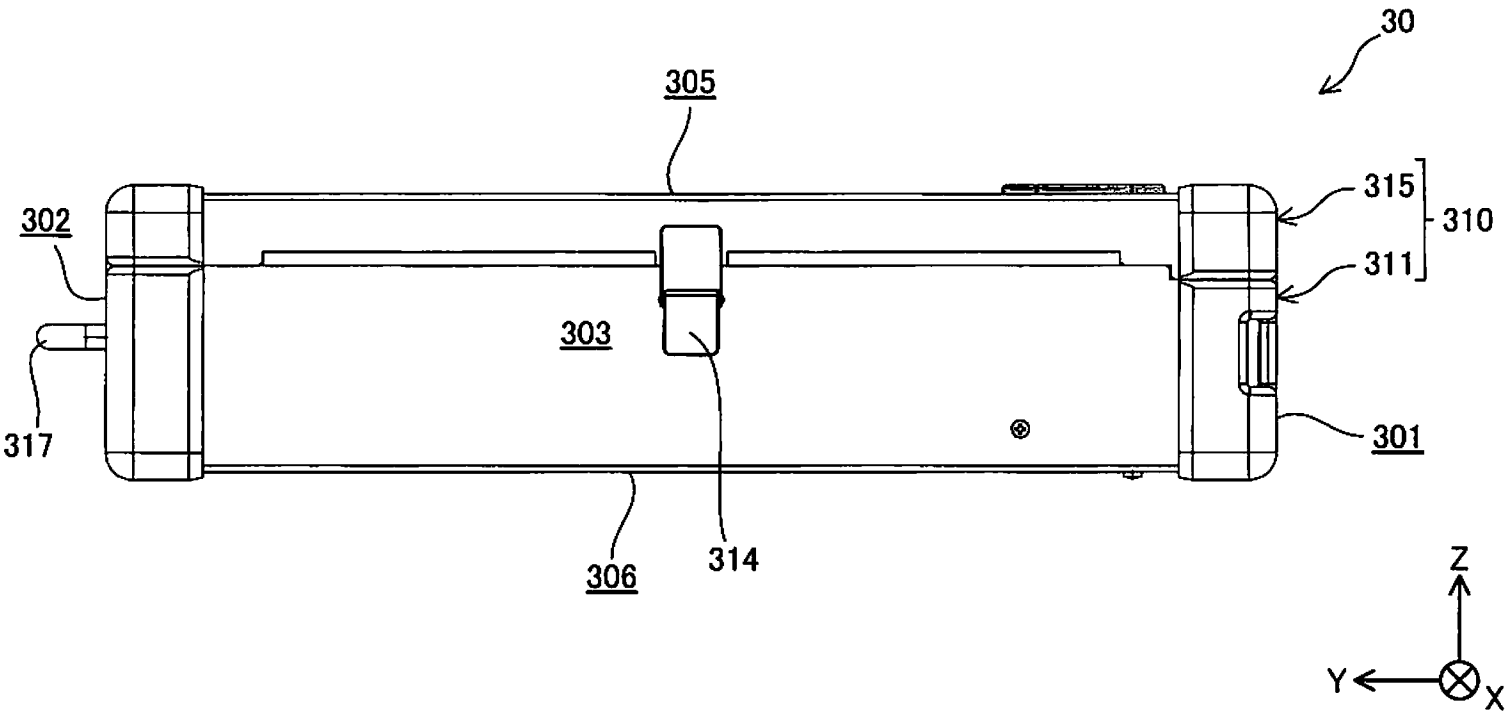
FIG. 22 is a right side surface diagram of an ink cartridge.
Figure 23:
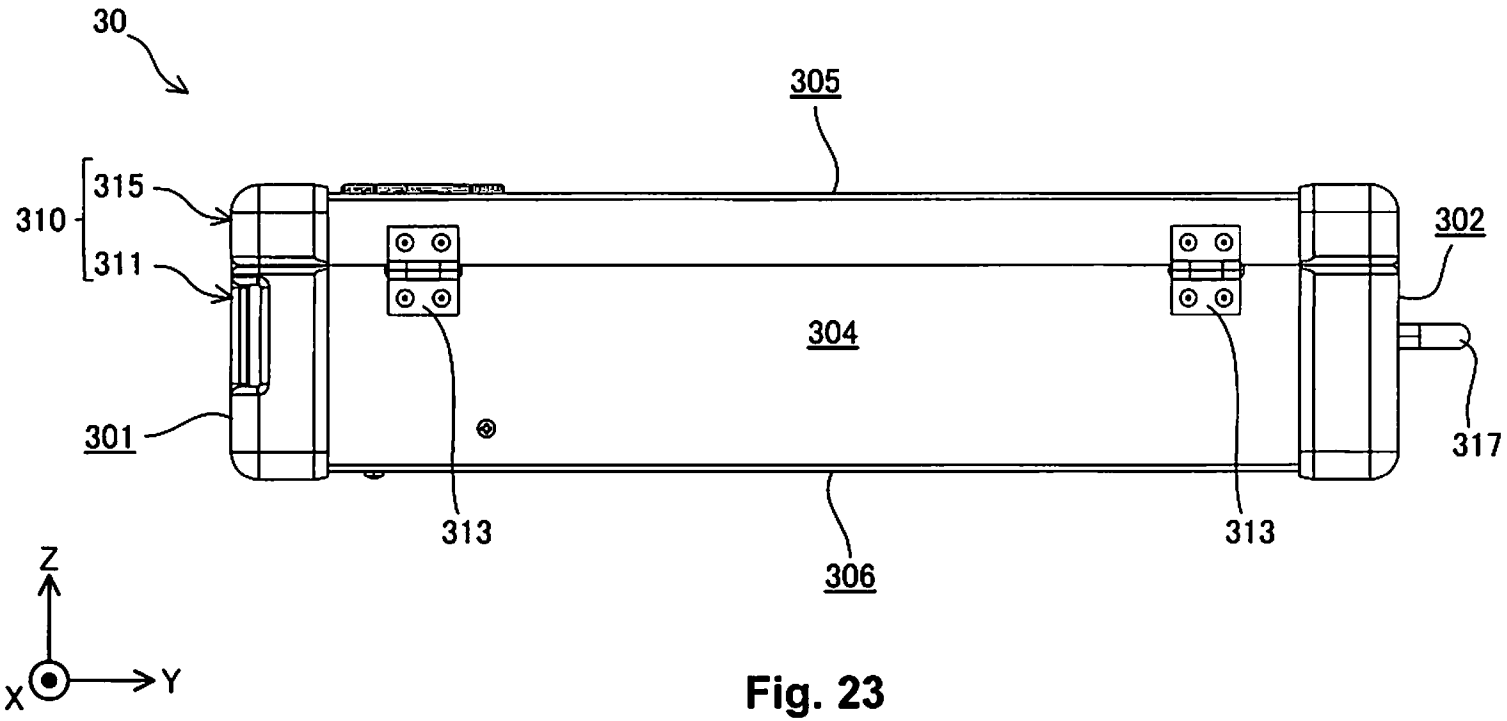
FIG. 23 is a left side surface diagram of an ink cartridge.
Figure 24:
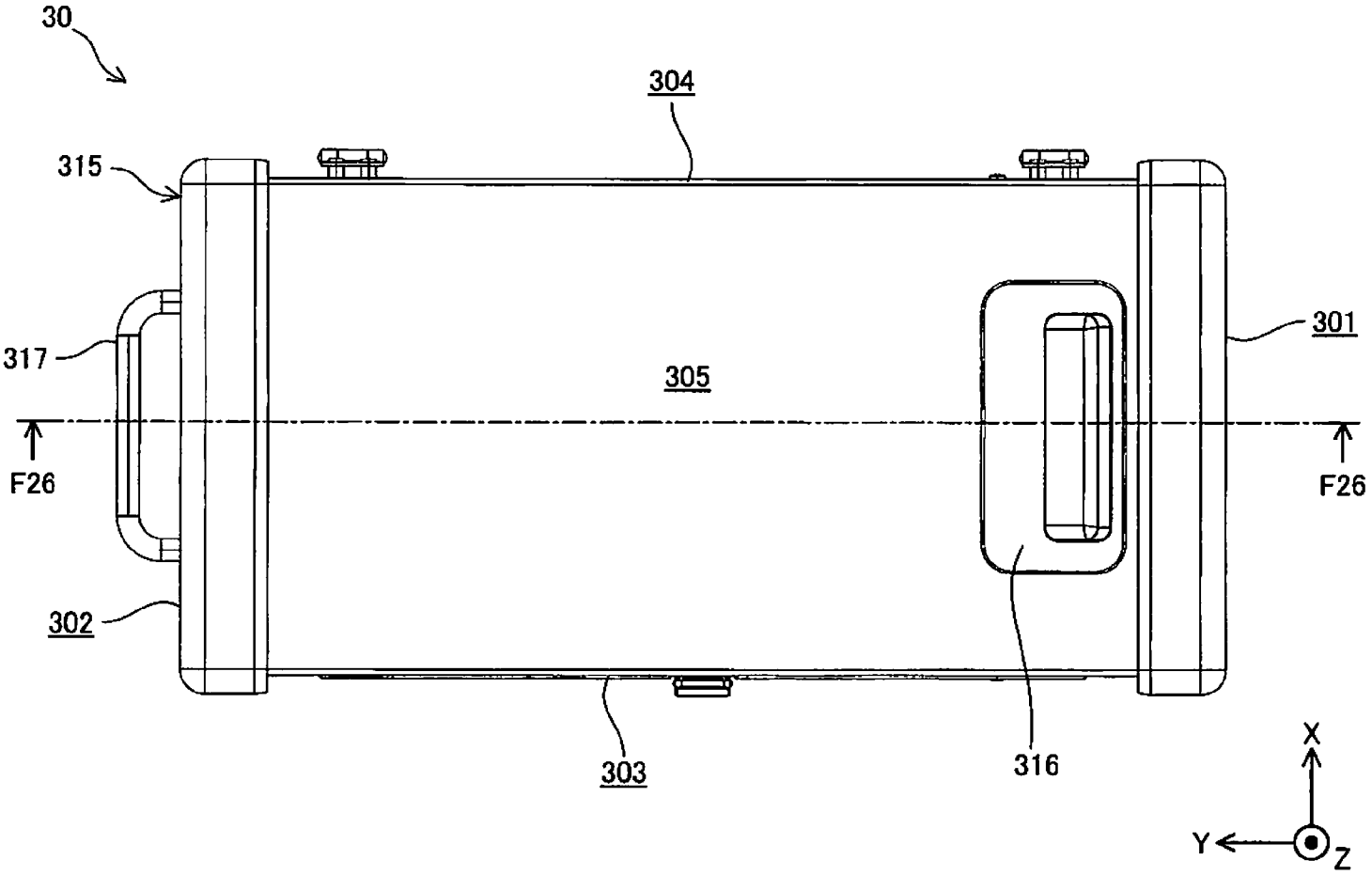
FIG. 24 is an upper surface diagram of an ink cartridge.
Figure 25:
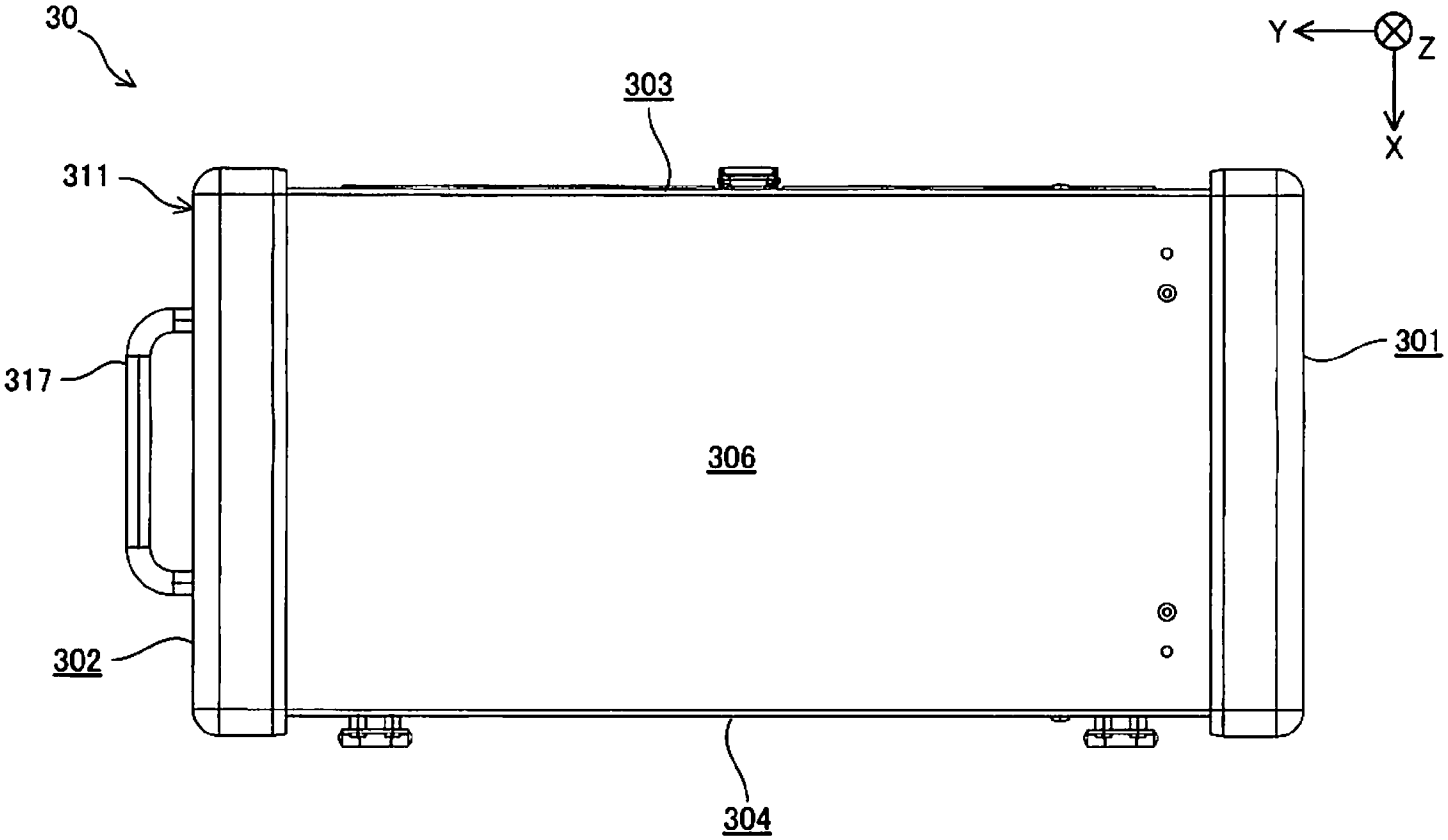
FIG. 25 is a bottom surface diagram of an ink cartridge.
Figure 26:
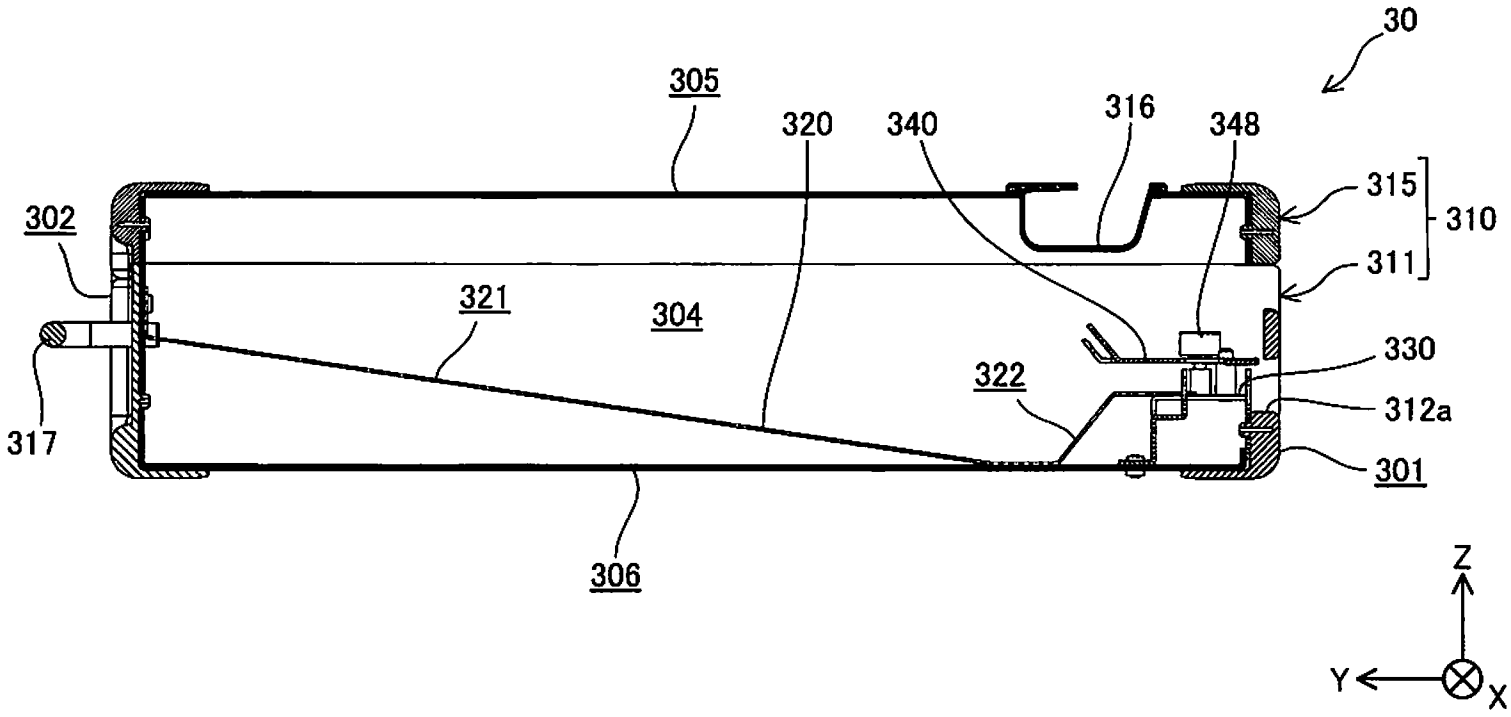
FIG. 26 is a cross sectional diagram of an ink cartridge.

FIG. 20 is a rear surface diagram of the ink cartridge 30. FIG. 21 is a front surface diagram of the ink cartridge 30. FIG. 22 is a right side surface diagram of the ink cartridge 30. FIG. 23 is a left side surface diagram of the ink cartridge 30. FIG. 24 is an upper surface diagram of the ink cartridge 30. FIG. 25 is a bottom surface diagram of the ink cartridge 30. FIG. 26 is a cross sectional diagram of the ink cartridge 30. The cross sectional diagram of FIG. 26 is a diagram which shows a cross section of the ink cartridge 30 viewed from an arrow line F26-F26 in FIG. 24.

The casing section 310 of the ink cartridge 30 is formed with a rectangular cub shape. Out of the dimensions of the casing section 310, the length in the Y axis direction is the longest, the length in the X axis direction is the next longest, and the length in the Z axis direction is the shortest. The casing section 310 has a first casing section 311 and a second casing section 315. The first casing section 311 configures the −Z, axis direction side of the casing section 310 and the second casing section 315 configures the +Z axis direction side of the casing section 310. The second casing section 315 configures the +Z axis direction side of the first casing section 311 so that it is possible to open and close as shown in FIG. 19. The casing section 310 has six wall sections 301, 302, 303, 304, 305, and 306.

The wall section 301 of the casing section 310 is a part along the ZX plane which is positioned on the −Y axis direction side in the casing section 310. An opening 312*a* into which the liquid supply tube 210 is inserted, an opening 312*b* into which the apparatus side terminal section 220 is inserted, and an opening 312*c* into which the apparatus side identifying section 230 is inserted are formed in the wall section 301. In the present embodiment, a shock absorbing member 311*fg* which absorbs shocks with regard to the wall section 301 is provided in the wall section 301 on the first casing section 311 side, and a shock absorbing member 315*fg* which absorbs shocks with regard to the wall section 301 is provided in the wall section 301 on the second casing section 315 side. In the present embodiment, the shock absorbing member 311*fg* and the shock absorbing member 315*fg* are formed from a composite resin.

The wall section 302 of the casing section 310 is a part along the ZX plane which is positioned on the +Y axis direction side in the casing section 310. A handle 317, which is able to be gripped by the user of the printing apparatus 10 when dealing with the ink cartridge 30, is provided in the wall section 302. In the present embodiment, a shock absorbing member 311*bg* which absorbs shocks with regard to the wall section 302 is provided in the wall section 302 on the first casing section 311 side, and a shock absorbing member 315*bg* which absorbs shocks with regard to the wall section 302 is provided in the wall section 302 on the second casing section 315 side. In the present embodiment, the shock absorbing member 311*bg* and the shock absorbing member 315*bg* are formed from a composite resin. In the present embodiment, the members which configure the casing section 310 except for the shock absorbing members 311*fg*, 311*bg*, 315*fg*, and 315*bg* are formed from stainless steel.

The wall section 303 of the casing section 310 is a part along the YZ plane which is positioned on the −X axis direction side in the casing section 310. A latch 314, which latches the first casing section 311 and the second casing section 315, is provided in the wall section 303. The wall section 304 of the casing section 310 is a part along the YZ plane which is positioned on the +X axis direction side in the casing section 310. Two hinges 313, which join the first casing section 311 and the second casing section 315, are formed in the wall section 304.

The wall section 305 of the casing section 310 is a part along the XY plane which is positioned on the +Z axis direction side in the casing section 310. A handle 316, where it is possible for the user of the printing apparatus 10 to hook with a finger when dealing with the ink cartridge 30, is provided in the wall section 305. The wall section 306 of the casing section 310 is a part along the XY plane which is positioned on the −Z axis direction side in the casing section 310.

As shown in FIG. 19 and FIG. 26, the placement member 320 and the platform member 330 are provided at an inner side on the casing section 310 as described above. The placement member 320 of the ink cartridge 30 has the inner wall 321 and the inner wall 322. The platform member 330 of the ink cartridge 30 has the regulating section 331, the regulating section 332, the wall section 334, and the wall section 336. The pressing member 340 is provided in the platform member 330 so as to be able to be attached and detached using a hand fastening screw 348. The platform member 330 further has an opening section 335, an opening section 337, a protruding section 338, and a screw section 339.

The opening section 335 of the platform member 330 is formed in the wall section 334 and engages with the engaging section 520 of the substrate holder 50. In the present embodiment, two of the opening sections 335 are formed in the platform member 330.

The opening section 337 of the platform member 330 is formed in the wall section 336 and engages with the engaging section 720 of the identifier holder 70. In the present embodiment, two of the opening sections 337 are formed in the platform member 330.

The protruding section 338 of the platform member 330 positionally aligns the pressing member 340 by engaging with the pressing member 340. In the present embodiment, two of the protruding sections 338 are formed in the platform member 330.

The screw section 339 of the platform member 330 fits together with the hand fastening screw 348. In the present embodiment, two of the screw sections 339 are formed in the platform member 330.

Figure 27:
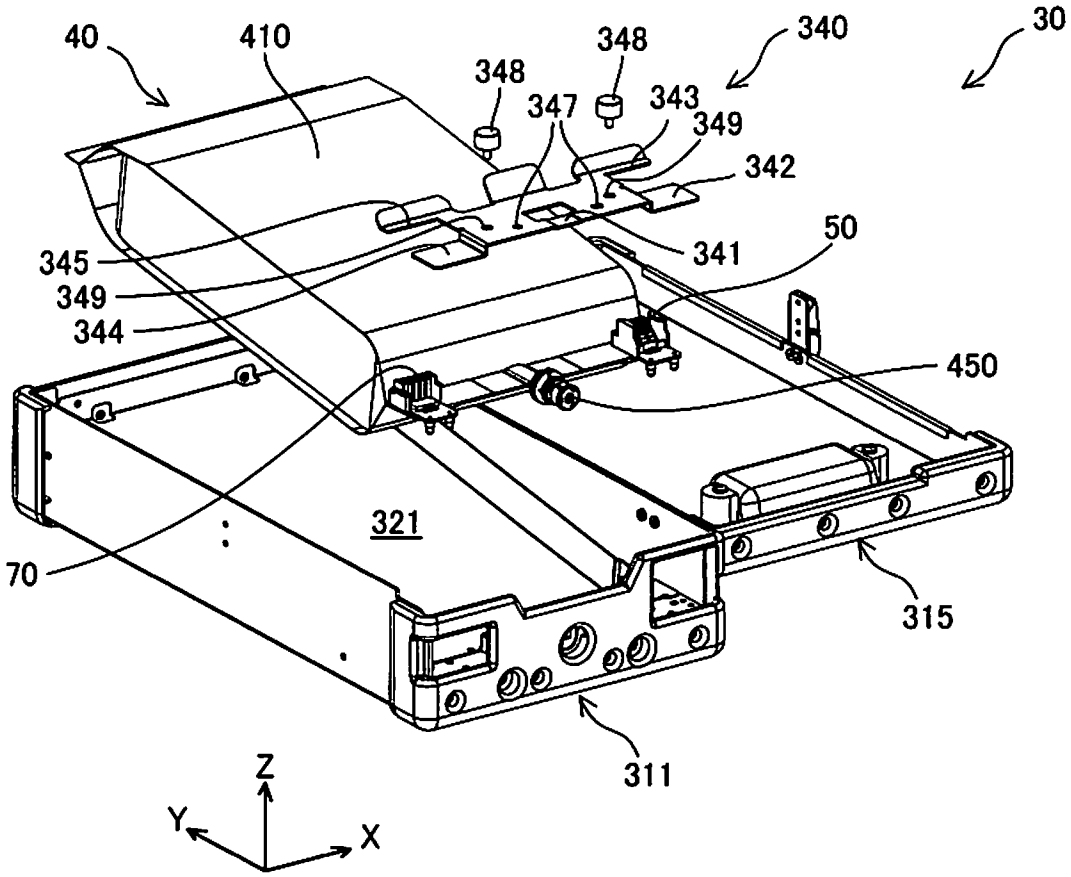
FIG. 27 is an exploded perspective diagram illustrating an ink cartridge where an ink pack and a pressing member are removed.

FIG. 27 is an exploded perspective diagram illustrating the ink cartridge 30 where the ink pack 40 and the pressing member 340 are removed. The pressing member 340 of the ink cartridge 30 has a pressing section 342, a pressing section 343, a pressing section 344, a pressing section 345, a through hole 349, and a through hole 347.

The pressing section 342 of the pressing member 340 comes into contact with regard to the pressed section 540 of the substrate holder 50 from the +Z axis direction and pushes the pressed section 540 in the −Z axis direction. The pressing section 343 of the pressing member 340 comes into contact with regard to the pressed section 550 of the substrate holder 50 from the +Z axis direction and pushes the pressed section 550 in the −Z axis direction.

The pressing section 344 of the pressing member 340 comes into contact with regard to the pressed section 740 of the identifier holder 70 from the +Z axis direction and pushes the pressed section 540 in the −Z axis direction. The pressing section 345 of the pressing member 340 comes into contact with regard to the pressed section 750 of the identifier holder 70 from the +Z axis direction and pushes the pressed section 750 in the −Z axis direction.

The through hole 347 of the pressing member 340 determines the position of the pressing member 340 with regard to the platform member 330 by engaging with the platform member 330. In the present embodiment, two of the through holes 347 are formed in the pressing member 340.

The through hole 349 of the pressing member 340 is where the hand fastening screw 348 passes through to the platform member 330. In the present embodiment, two of the through holes 349 are formed in the pressing member 340 and the pressing member 340 is fixed to the platform member 330 using two of the hand fastening screws 348.

Figure 28:
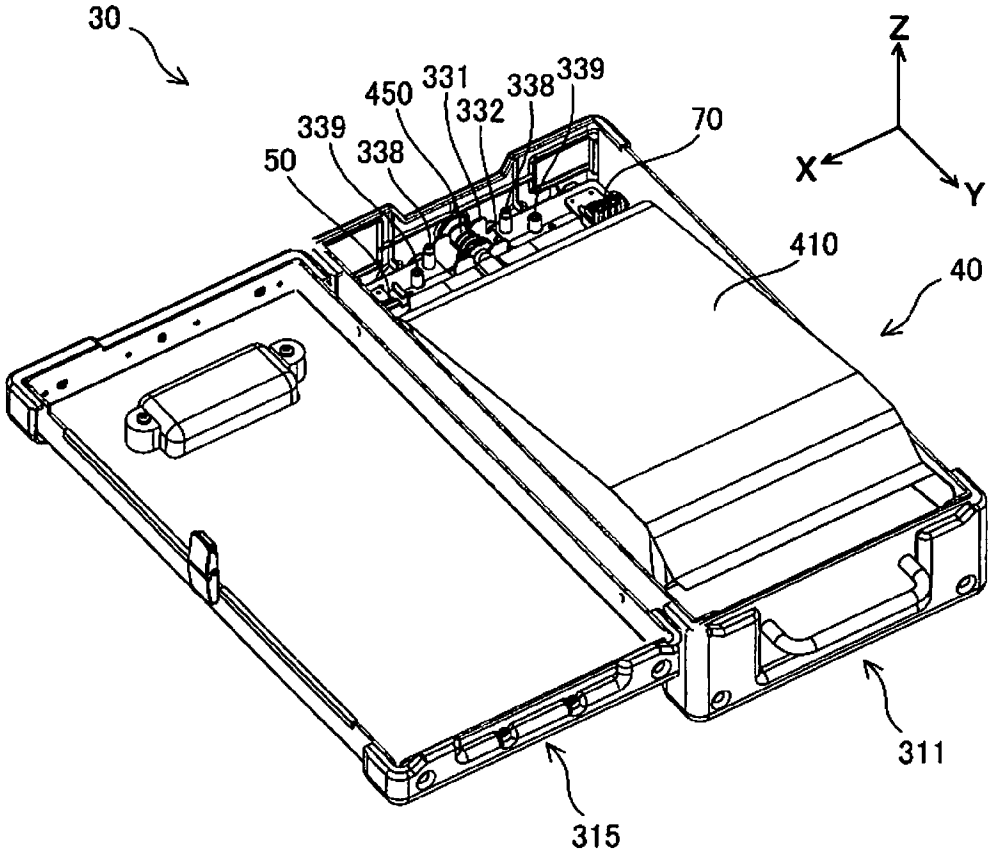
FIG. 28 is a perspective diagram illustrating an ink cartridge where an ink pack is attached and a pressing member is removed.

FIG. 28 is a perspective diagram illustrating the ink cartridge 30 where the ink pack 40 is attached and the pressing member 340 is removed. In the state in FIG. 28, the liquid containing section 410 of the ink pack 40 is placed on the inner wall 321, and the substrate holder 50 and the identifier holder 70 of the ink pack 40 are attached to the platform member 330. To accompany this, the liquid supply member 450 of the ink pack 40 is positionally aligned on the +Z axis direction side of the regulating section 331 and the regulating section 332.

Figure 29:
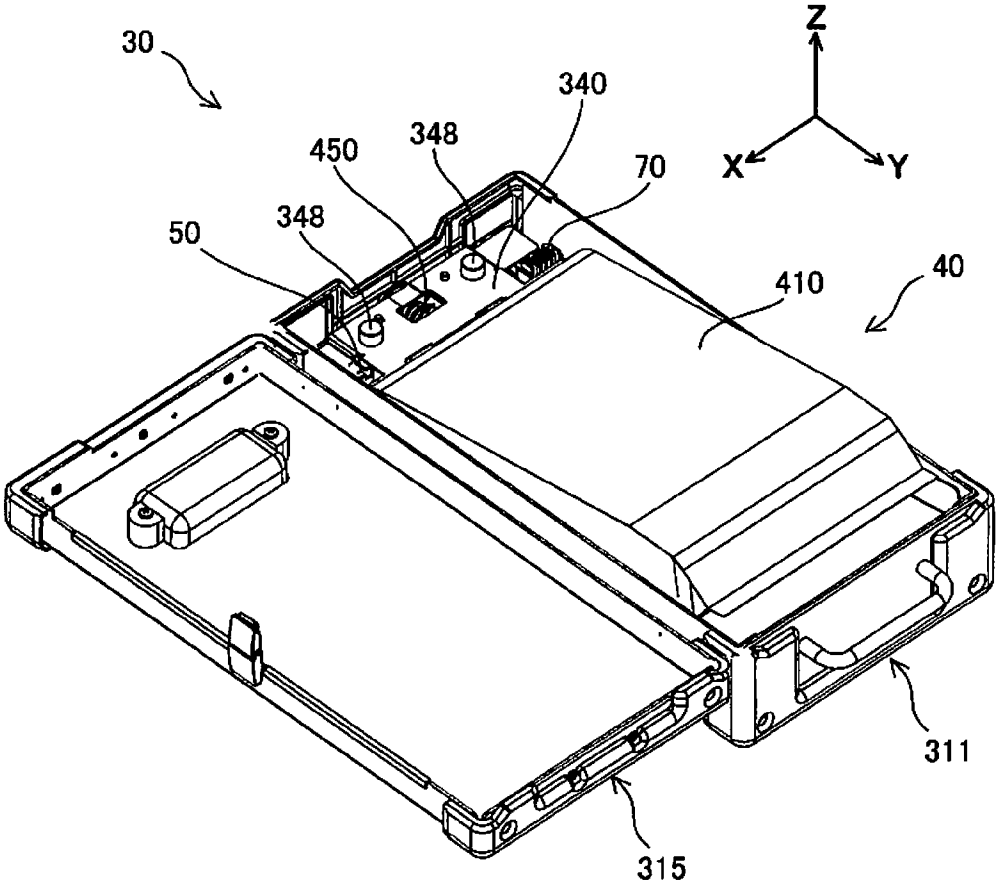
FIG. 29 is a perspective diagram illustrating an ink cartridge where an ink pack and a pressing member are attached.

FIG. 29 is a perspective diagram illustrating the ink cartridge 30 where the ink pack 40 and the pressing member 340 are attached. In the state in FIG. 29, the pressing member 340 is fixed to the platform member 330 using the hand fastening screws 348. To accompany this, the substrate holder 50, the identifier holder 70, and the liquid supply member 450 of the ink pack 40 are pushed to the −Z axis direction by the pressing member 340.

Figure 30:
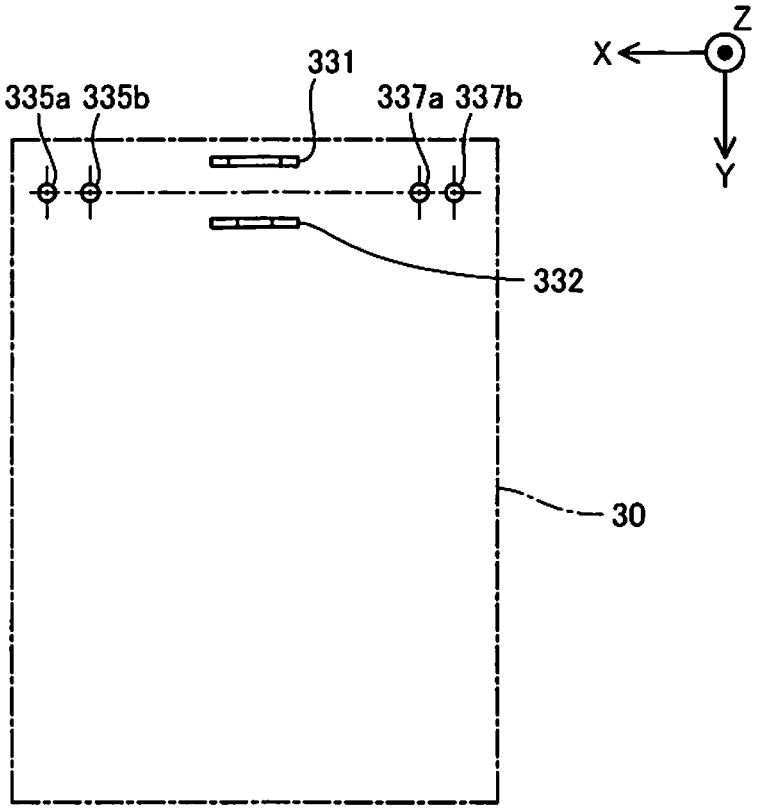
FIG. 30 is an explanatory diagram illustrating the positional relationship between opening sections.

FIG. 30 is an explanatory diagram illustrating the positional relationship between the opening section 335 and the opening section 337. The platform member 330 of the ink cartridge 30 has an opening section 335*a* and an opening section 335*b* as two of the opening sections 335 and has an opening section 337*a* and an opening section 337*b* as two of the opening sections 337. In the explanation of the present embodiment, the reference numeral "335" and the reference numeral "337" are used in cases where both of the two opening sections in the platform member 330 are being referred to, and the reference numerals where "a" is added is used for the openings on the +X axis direction side the reference numerals where "b" is added is used for the openings on the −X axis direction side in cases where each of the two respective opening sections in the platform member 330 are being specified individually.

In the present embodiment, the opening sections 335 are positioned between the regulating section 331 and the regulation section 332 in the Y axis direction. In the present embodiment, the opening sections 337 are positioned between the regulating section 331 and the regulation section 332 in the Y axis direction.

Figure 31:
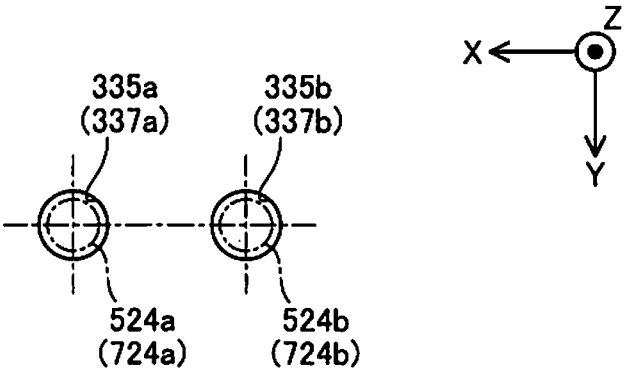
FIG. 31 is an explanatory diagram illustrating the relationship between opening sections in a platform member and protruding sections of a substrate holder.

FIG. 31 is an explanatory diagram illustrating the relationship between the opening sections 335*a* and 335*b* in the platform member 330 and the protruding sections 524*a* and 524*b* of the substrate holder 50. In the present embodiment, the inner diameters of the opening sections 335*a* and 335*b* are larger than the outer shapes of the protruding sections 524*a* and 524*b*. For this reason, the protruding sections 524*a* and 524*b* are separated from at least a portion of the inner side surfaces of the opening sections 335*a* and 335*b* in a state of being inserted in the opening sections 335*a* and 335*b*. In the present embodiment, the relationship between the opening sections 337*a* and 337*b* in the platform member 330 and the protruding sections 724*a* and 724*b* of the identifier holder 50 is the same.

A-2. Effects

According to the first embodiment described above, the substrate holder 50 is provided with the engaging section 520 which is positioned more to the −Y axis direction side than the contact sections 610, the engaging section 530 which is positioned more to the +Y axis direction side than the contact sections 610, the pressed section 540 which is positioned more to the −Y axis direction side than the contact sections 610, and the pressed section 550 which is positioned more to the +Y axis direction side than the contact sections 610. Due to this, since the substrate holder 50 is positionally aligned in the ink cartridge 30 at both positions on the +Y axis direction and the −Y axis direction of the contact sections 610 with regard to the Y axis direction in which the ink cartridge 30 is inserted, it is possible to prevent positional deviation of the contact sections 610 which accompanies inserting of the ink cartridge 30 in the cartridge holder 20. Accordingly, electrical connection between the substrate 60 and the printing apparatus 10 is possible without forming conduction paths in the ink cartridge 30. As a result, it is possible to suppress conduction problems between the substrate 60 and the printing apparatus 10.

In addition, the substrate holder 50 is provided with the substrate holding section 510 which holds the substrate 60 with a posturing where the contact sections 610 face the −Y axis direction and the +Z axis direction. Due to this, it is possible to suppress contact problems between the contact sections 610 and the apparatus side terminal section 220.

In addition, the pressed section 550 receives a pressing force at a position more to the +Z axis direction side than a position where the pressed section 540 receives a pressing force. According to this aspect, it is possible to prevent damage to the liquid containing section 410 due to the pressing member 340 which presses the pressed section 550 in the −Z axis direction since it is possible to separate between the pressed section 550 and the liquid containing section 410 in the Z axis direction.

In addition, the substrate holder 50 is provided with the plurality of engaging sections 520*a* and 520*b*. Due to this, it is possible to achieve easier positional aligning of the substrate holder 50 in the ink cartridge 30 and to further prevent positional deviation of the substrate 60 which accompanies inserting of the ink cartridge 30 in the cartridge holder 20.

In addition, the end section member 451 of the liquid supply member 450 is pushed in the −Z axis direction by the pressing member 340. Due to this, it is possible to suppress prevent positional deviation of the liquid supply member 450 which accompanies inserting of the ink cartridge 30 in the cartridge holder 20. As a result, it is possible to further prevent positional deviation of the substrate 60 which accompanies positional deviation of the liquid supply member 450.

In addition, the protruding sections 524*a* and 524*b* of the engaging sections 520*a* and 520*b* in the substrate holder 50 are separated from at least a portion of the inner side surfaces of the opening sections 335*a* and 335*b*. Due to this, it is possible to easily perform positional aligning of the liquid supply member 450 with regard to the ink cartridge 30.

In addition, the identifier holder 70 is provided with the engaging section 720 which is positioned more to the −Y axis direction side than the contact sections 610 and the engaging section 730 which is positioned more to the +Y axis direction side than the contact sections 610. Due to this, since the identifier holder 70 is positionally aligned in the ink cartridge 30 along with the substrate holder 50 at both positions on the +Y axis direction and the −Y axis direction of the contact sections 610 with regard to the Y axis direction in which the ink cartridge 30 is inserted, it is possible to further prevent positional deviation of the contact sections 610 which accompanies inserting of the ink cartridge 30 in the cartridge holder 20.

In addition, the identifier holder 70 is provided with the pressed section 740 which is positioned more to the −Y axis direction side than the contact sections 610 and the pressed section 750 which is positioned more to the axis direction side than the contact sections 610. Due to this, it is possible to suppress positional deviation of the identifier holder 70 with regard to the ink cartridge 30.

B. Second Embodiment

A second embodiment is the same as the first embodiment except for the point that the shape of the opening section 335*a* in the platform member 330 in the ink cartridge 30 is different.

Figure 32:
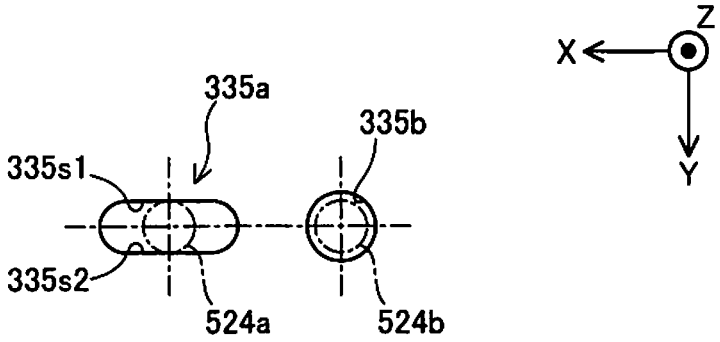
FIG. 32 is an explanatory diagram illustrating the relationship between opening sections in a platform member and protruding sections of a substrate holder in a second embodiment.

FIG. 32 is an explanatory diagram illustrating the relationship between the opening sections 335*a* and 335*b* in the platform member 330 and the protruding sections 524*a* and 524*b* of the substrate holder 50 in the second embodiment. The opening section 335*a* in the platform member 330 in the second embodiment has a first inner side surface 335*s*1 and a second inner side surface 335*s*2 which are along the X axis and oppose each other. The distance between the first inner side surface 335*s*1 and the second inner side surface 335*s*2 is shorter than the diameter of the opening section 335*b*.

In the present embodiment, the protruding section 524*a* of the substrate holder 50 fits between the first inner side surface 335*s*1 and the second inner side surface 335*s*2. That is, the protruding section 524*a* comes into contact with the inner side surfaces of the opening section 335*a* in the Y axis direction. Due to this, the protruding section 524*a* regulates movement of the substrate holder 50 in the Y axis direction.

According to the second embodiment, it is possible to easily attach the substrate holder 50 with regard to the ink cartridge 30 due to the substrate holder 50 being shifted in the X axis direction in a state where the protruding section 524*a* is inserted with regard to the opening section 335*a* prior to inserting of the protruding section 524*b* with regard to the opening section 335*b* when the substrate holder 50 is attached to the ink cartridge 30.

According to the second embodiment, the position of the substrate holder 50 is determined with regard to the ink cartridge 30 in the Z axis direction due to contacting of the protruding section 552*a* of the substrate holder 50 with regard to the wall section 334 of the platform member 330 on the +Z axis direction side of the opening section 335*a* from the +Z axis direction, and movement of the substrate holder 50 in the Y axis direction is regulated due to contacting of the protruding section 524*a* of the substrate holder 50 with regard to the first inner side surface 335*s*1 and the second inner side surface 335*s*2 of the opening section 335*a* in the Y axis direction. Due to this, it is possible to prevent positional deviation of the substrate 60 in the Y axis direction and the Z axis direction. As a result, it is possible to suppress connection problems between the contact sections 610 of the substrate 60 and the apparatus side terminal section 220.

As a modified example of the second embodiment, the opening section 337*b* may have a slot shape in the same manner as the opening section 335*a*. Due to this, it is possible to easily attach the substrate holder 50 and the identifier holder 70 with regard to the ink cartridge 30. In addition, it is possible to secure precision in positional aligning of the liquid supply member 450 since the opening section 335*b* and the opening section 337*a* which are close to the liquid supply member 450 are circular shapes.

As a modified example of the second embodiment, the opening section 335*a* and the opening section 337*b* may have a circular shape, and the opening section 335*b* and the opening section 337*a* may have a slot shape. Due to this, it is possible to easily attach the substrate holder 50 and the identifier holder 70 with regard to the ink cartridge 30. In addition, it is possible to suppress the liquid containing section 410 from changing shape which is caused by collapsing of the liquid containing section 410 which accompanies consumption of UV ink since it is easy for the liquid containing section 410 to get pulled to the outside in the X axis direction.

C. Third Embodiment

A third embodiment is the same as the first embodiment except for the point of providing a substrate holder which is different to the first embodiment.

Figure 33:
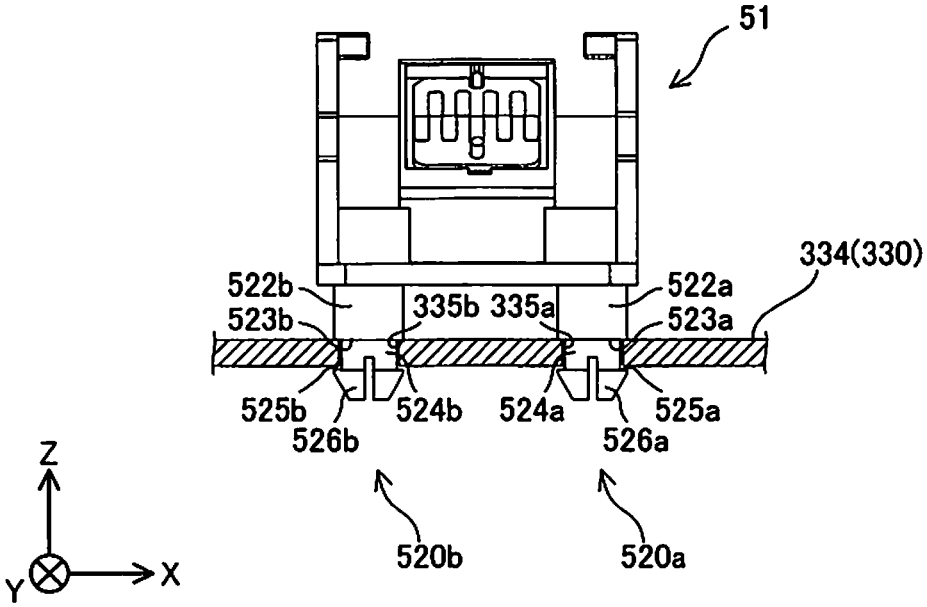
FIG. 33 is an explanatory diagram illustrating a substrate holder in a third embodiment.

FIG. 33 is an explanatory diagram illustrating a substrate holder 51 in the third embodiment. The substrate holder 51 in the third embodiment is the same as in the first embodiment except for the point of providing the engaging section 520 with a shape which is different to the first embodiment.

The engaging section 520*a* of the substrate holder 51 further has a fastening section 526*a* which is formed with a surface 525*a* which faces the +Z axis direction. The fastening section 526*a* is provided on the −Z axis direction side of the protruding section 524*a* and is clasped by engaging with the wall section 334 due to contacting with regard to the wall section 334 of the platform member 330 on the −Z axis direction side of the opening section 335*a* at the surface 525*a* from the −Z axis direction. Due to this, the fastening section 526*a* regulates movement of the liquid supply member 450 in the +Z axis direction through the supply side adhering section 420.

The engaging section 520*b* of the substrate holder 51 further has a fastening section 526*b* which is formed with a surface 525*b* which faces the +Z axis direction. The fastening section 526*b* is provided on the −Z axis direction side of the protruding section 524*b* and is clasped by engaging with the wall section 334 due to contacting with regard to the wall section 334 of the platform member 330 on the −Z axis direction side of the opening section 335*b* at the surface 525*b* from the −Z axis direction. Due to this, the fastening section 526*b* regulates movement of the liquid supply member 450 in the +Z axis direction through the supply side adhering section 420.

According to the third embodiment, it is possible to prevent positional deviation of the liquid supply member 450 in the +Z axis direction in addition to position deviation of the liquid supply member 450 in the −Z axis direction due to positional aligning of the substrate holder 50. For this reason, it is possible to further reduce the time taken in assembling the ink pack 40 in the ink cartridge 30.

D. Fourth Embodiment

A fourth embodiment is the same as the first embodiment except for the point that the positions where the substrate holder 50 and the identifier holder 70 are attached to the liquid containing section 410 are different.

Figure 34:
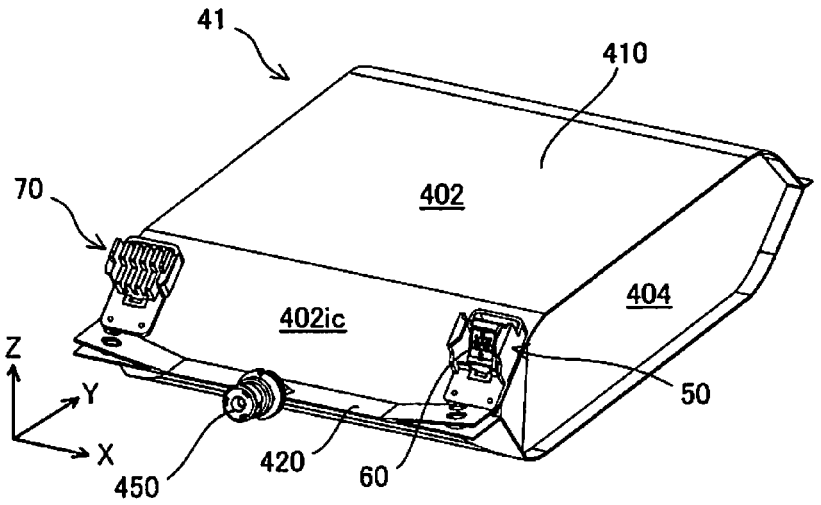
FIG. 34 is an explanatory diagram illustrating an ink pack in a fourth embodiment.

FIG. 34 is an explanatory diagram illustrating an ink pack 41 in the fourth embodiment. The ink pack 41 of the fourth embodiment is the same as the ink pack 40 of the first embodiment except for the point that the substrate holder 50 and the identifier holder 70 are attached to the flexible member 402 at an inclined surface 402*ic* which faces the −Y axis direction and the +Z axis direction.

Figure 35:
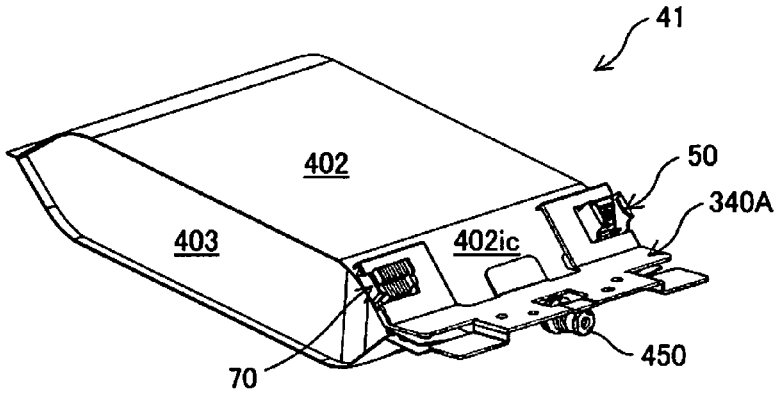
FIG. 35 is an explanatory diagram illustrating an ink pack and a pressing member in a fourth embodiment.

FIG. 35 is an explanatory diagram illustrating the ink pack 41 and a pressing member 340A in the fourth embodiment. The pressing member 340A of the fourth embodiment is the same as the pressing member 340 of the first embodiment except for the point of having a shape according to the positions of the substrate holder 50 and the identifier holder 70 in the ink pack 41.

According to the fourth embodiment, at least a portion of the substrate 60 overlaps with the liquid inflow section 408 when viewing the liquid containing section 410 from the +Z axis direction. Due to this, it is possible to suppress positional deviation of the substrate 60 which accompanies inserting of the ink cartridge 30 in the cartridge holder 20 due to the substrate 60 overlapping with the liquid inflow section 408 where it is easy for shocks to be absorbed due to the adhering section. As a result, it is possible to further suppress connection problems between the contact sections 610 and the apparatus side terminal section 220.

E. Fifth Embodiment

A fifth embodiment is the same as the first embodiment except for the point that the positions where the substrate holder 50 and the identifier holder 70 are attached to the liquid containing section 410 are different.

Figure 36:
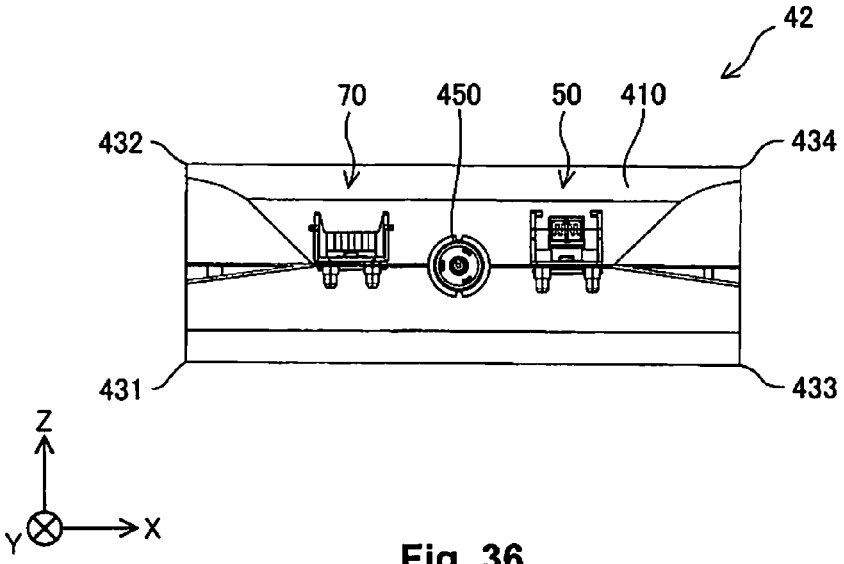
FIG. 36 is an explanatory diagram illustrating an ink pack in a fifth embodiment.

FIG. 36 is an explanatory diagram illustrating an ink pack 42 in the fifth embodiment. The ink pack 42 of the fifth embodiment is the same as the ink pack 40 of the first embodiment except for the point that the substrate holder 50 and the identifier holder 70 are attached near the liquid supply member 450. That is, the substrate holder 50 is provided at a position which is closer to the liquid supply member 450 than the adhering sections 433 and 434 which are edge sections of the liquid containing section 410 in the X direction. The identifier holder 70 is provided at a position which is closer to the liquid supply member 450 than the adhering sections 431 and 432 which are edge sections of the liquid containing section 410 in the X direction.

According to the fifth embodiment, it is possible to suppress bias in the moment of the force which acts on the liquid containing section 410 which is centered on the liquid supply member 450. For this reason, it is possible to prevent positional deviation of the substrate 60 which accompanies inserting of the ink cartridge 30 in the cartridge holder 20. As a result, it is possible to further suppress connection problems between the contact sections 610 and the apparatus side terminal section 220.

F. Other Embodiments

The present invention is not limited to the embodiments, applied examples, and modified examples described above and it is possible for the present invention to be realized with various configurations within a scope which does not depart from the gist of the present invention. For example, it is possible for the technical features in the embodiments, applied examples, and modified examples, which correspond to the technical features of the respective aspects which are detailed under the heading of the Summary of the Invention, to be appropriately replaced or combined in order to solve a portion or all of the problems described above or in order to achieve a portion or all of the effects described above. In addition, appropriate omissions are possible if the technical features are not described as essential in the specifications. For example, the configuration of the substrate holder may be applied to the identifier holder and the configuration of the identifier holder may be applied to the substrate holder. In addition, the present invention may be applied to a configuration where the substrate is provided on the ink cartridge side instead of a configuration where the substrate is provided on the ink pack side.

At least one of the thin and long protuberances in the substrate holder, the identifier holder, and the apparatus side terminal section may partially be a protruding section. In addition, the substrate may be a substrate (a flexible substrate) with flexibility which is manufactured using resin or the like. In addition, the substrate holding section of the substrate holder may have a configuration where the substrate is held when the contact sections of the substrate connect with the terminals of the apparatus side terminal section.

"Fusing" of the flexible members is included in "adhering" of the flexible members in the liquid containing section. The flexible members in the liquid containing section are not limited to being "adhered" and it is sufficient if the flexible members are "bonded".

The present invention is not limited to the ink cartridge which contains UV ink. In addition, it is possible to also apply the present invention to liquid ejecting apparatuses, which eject other liquids which are cured by illuminating with light with a wavelength which is different to ultraviolet rays, and to liquid containing vessels for these liquid ejecting apparatuses. For example, it is possible to apply the present invention to the following types of liquid ejecting apparatuses and to liquid containing vessels for these liquid ejecting apparatuses.

- Image recording apparatuses such as a facsimile
- Colorant ejecting apparatuses which are used in manufacturing color filters for image display apparatuses such as liquid crystal displays
- Electrode material ejecting apparatuses which are used in forming electrodes in organic electroluminescence (EL) displays, field emitting displays (FED), and the like
- Liquid ejecting apparatuses which eject liquids which include bio-organic material which is used in biochip manufacturing
- Sample ejecting apparatuses which are used as precision pipettes
- Ejecting apparatuses for lubricating oil
- Ejecting apparatuses for resin liquids
- Liquid ejecting apparatuses which eject a lubricant in a pin point manner in precision machines such as watches or cameras
- Liquid ejecting apparatuses which eject a transparent resin liquid such as an ultraviolet curable liquid onto a substrate in order to form minute hemispherical lenses (optical lenses) which are used in optical communication elements or the like
- Liquid ejecting apparatuses which eject an etching liquid such as an acid or an alkali in order to etch a substrate or the like
- Liquid ejecting apparatuses which are provided with a liquid ejecting head which discharges other arbitrary liquid droplets in minute amounts Here, "liquid droplets" refers to the state of liquid which is discharged from the liquid ejecting apparatus and includes liquid with a granular shape, liquid with a tear shape, and liquid with a trailing shape. In addition, it is sufficient if the "liquid" referred to here is a material which is able to be ejected by the liquid ejecting apparatus. For example, it is sufficient if the "liquid" is in a state where a substance is in a liquid phase, and material in a liquid state such as a sol, a gel water, an inorganic solvent, an organic solvent, a solution, a liquid resin, or a liquid metal (a metal melt) is included as the "liquid". In addition, not only liquids of a substance in one state are included but particles of a functional material formed of solid matter such as pigments and metal particles being dissolved, dispersed, or mixed into a solvent and the like are also included as the "liquid". Typical examples of the liquids include inks, liquid crystals, and the like. Here, the "ink" encompasses various types of liquid compositions such as typical water-based inks and oil-based inks, gel inks, and hot melt inks.

In addition, "blocking light" and "securing light blocking" refers to having the property of light being blocked and it is sufficient in the present embodiment if light blocking is a property where light of a wavelength which cures ink is blocked in a case of being irradiated with regard to the ink.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A substrate support member configured to support a substrate in a liquid ejecting apparatus that includes a liquid containing body with a flexible liquid containing section that contains a liquid, a liquid containing vessel that contains the liquid containing body, a mounting section to which the liquid containing vessel is attachably and detachably mounted, the mounting section having an apparatus side insertion opening that is formed on a +Y axis direction side and an apparatus side wall section that is formed on a −Y axis direction side, and the liquid containing vessel being inserted in the mounting section in the −Y axis direction from the apparatus side insertion opening to the apparatus side wall section, a liquid supply tube provided to the apparatus side wall section and receiving supply of the liquid from the liquid containing body, and an apparatus side terminal section provided to the apparatus side wall section and electrically connected due to contact with regard to a contact section of the substrate that is provided in the liquid containing body, where three spatial axes that are orthogonal to each other have an X axis, a Y axis, and a Z axis where, out of X axis directions along the X axis, a positive direction is a +X axis direction and a negative direction is a −X axis direction, out of Y axis directions along the Y axis, a positive direction is the +Y axis direction and a negative direction is the −Y axis direction, and out of Z axis directions along the Z axis, a positive direction is a +Z axis direction and a negative direction is a −Z axis direction, the substrate support member comprising:

a first engaging section configured to engage with regard to the liquid containing vessel from the +Z axis direction side at a position more to the −Y axis direction side than the contact section;

a second engaging section configured to engage with the liquid containing section at a position more to the +Y axis direction side than the substrate, and provided more to the −Z axis direction side than the contact section;

a first pressed section configured to receive a first pressing force with a component in the −Z axis direction at a position more to the −Y axis direction side than the contact section; and a second pressed section configured to receive a second pressing force with a component in the −Z axis direction at a position more to the +Y axis direction side than the contact section and more to the +Z axis direction side than a position where the first pressed section receives the first pressing force, where the X axis, the Y axis, and the Z axis with regard to the liquid containing vessel in a state of being mounted in the mounting section are three spatial axes in the liquid containing vessel.

2. The substrate support member according to claim 1, further comprising:

a substrate support section configured to hold the substrate with a posturing where the contact section faces the −Y axis direction and the +Z axis direction.

3. The substrate support member according to claim 1, wherein there is a plurality of the first engaging sections.

4. A liquid containing vessel configured to be attachably and detachably mounted with regard to a mounting section that is provided to a liquid ejecting apparatus and has an apparatus side insertion opening that is formed on a +Y axis direction side and an apparatus side wall section that is formed on a −Y axis direction side by being inserted in the mounting section in the −Y axis direction from the apparatus side insertion opening to the apparatus side wall section, where three spatial axes that are orthogonal to each other have an X axis, a Y axis, and a Z axis where, out of X axis directions along the X axis, a positive direction is a +X axis direction and a negative direction is a −X axis direction, out of Y axis directions along the Y axis, a positive direction is the +Y axis direction and a negative direction is the −Y axis direction, and out of Z axis directions along the Z axis, a positive direction is a +Z axis direction and a negative direction is a −Z axis direction, the liquid containing vessel comprising:

a liquid containing body with a flexible liquid containing section that contains a liquid;

a casing section containing the liquid containing body;

a substrate with a contact section that electrically connects due to contact with regard to an apparatus side terminal section provided to the apparatus side wall section; and a substrate support member supporting the substrate, the substrate support member including a first engaging section engaging with regard to the casing section from the +Z axis direction side at a position more to the −Y axis direction side than the contact section, a second engaging section engaging with the liquid containing section at a position more to the +Y axis direction side than the substrate, and provided more to the −Z axis direction side than the contact section, a first pressed section configured to receive a first pressing force with a component in the −Z axis direction at a position more to the −Y axis direction side than the contact section, and a second pressed section configured to receive a second pressing force with a component in the −Z axis direction at a position more to the +Y axis direction side than the contact section and more to the +Z axis direction side than a position where the first pressed section receives the first pressing force, where the X axis, the Y axis, and the Z axis with regard to the liquid containing vessel in a state of being mounted in the mounting section are three spatial axes in the liquid containing vessel.

5. The liquid containing vessel according to claim 4, wherein the substrate support member further includes a substrate support section that holds the substrate with a posturing where the contact section faces the −Y axis direction and the +Z axis direction.

6. The liquid containing vessel according to claim 4, wherein there is a plurality of the first engaging sections.

7. The liquid containing vessel according to claim 4, wherein the liquid containing body further includes a liquid supply member that is configured to supply the liquid from the liquid containing section to a liquid supply tube provided to the apparatus side wall section, and the liquid supply member includes a third pressed section that is configured to receive a third pressing force with a component in the −Z axis direction.

8. The liquid containing vessel according to claim 4, wherein the first engaging section includes a protruding section that protrudes in the −Z axis direction, the casing section has an opening section that receives insertion of the protruding section, and the protruding section is separated from at least a portion of an inner side surface of the opening section in a state of being inserted in the opening section.

9. The liquid containing vessel according to claim 8, wherein the liquid containing body further includes a liquid supply member that is configured to supply the liquid from the liquid containing section to a liquid supply tube provided in the apparatus side wall section, the protruding section includes a first protruding section and a second protruding section that protrude in the −Z axis direction, the opening section includes a first opening section that receives insertion of the first protruding section and a second opening section that is formed more to the liquid supply member side than the first opening section and receives insertion of the second protruding section, the second opening section has an opening with a circular cross section, the first opening section has an opening with a first inner surface and a second inner surface that extend along the X axis and oppose each other, and the distance between the first inner surface and the second inner surface is shorter than the diameter of the circular cross section.

10. The liquid containing vessel according to claim 8, wherein the liquid containing body further includes a liquid supply member that is configured to supply the liquid from the liquid containing section to a liquid supply tube provided in the apparatus side wall section, the protruding section includes a first protruding section and a second protruding section that protrude in the −Z axis direction, the opening section includes a first opening section that receives insertion of the first protruding section and a second opening section that is formed more to the liquid supply member side than the first opening section and receives insertion of the second protruding section, the first opening section has an opening with a circular cross section, the second opening section has an opening with a first inner surface and a second inner surface that extend along the X axis and oppose each other, and the distance between the first inner surface and the second inner surface is shorter than the diameter of the circular cross section.

11. The liquid containing vessel according to claim 4, further comprising:

an additional member different from the substrate support member, the additional member including a third engaging section engaging with the casing section from the +Z axis direction side at a position more to the −Y axis direction than the contact section, and a fourth engaging section engaging with the liquid containing section at a position more to the +Y axis direction than the substrate, and provided more to the −Z axis direction than the contact section.

12. The liquid containing vessel according to claim 11, wherein the third engaging section includes a protruding section that protrudes in the −Z axis direction, the casing section has an opening section that receives insertion of the protruding section of the third engaging section, and the protruding section of the third engaging section is separated from at least a portion of an inner side surface of the opening section in a state of being inserted in the opening section.

13. The liquid containing vessel according to claim 11, wherein the additional member further includes a third pressed section configured to receive a third pressing force with a component in the axis direction at a position more to the −Y axis direction side than the contact section, and a fourth pressed section configured to receive a fourth pressing force with a component in the −Z axis direction at a position more to the +Y axis direction side than the contact section.

14. A liquid containing body configured to be contained in a liquid containing vessel attachably and detachably mounted with regard to a mounting section that is provided to a liquid ejecting apparatus and has an apparatus side insertion opening that is formed on a +Y axis direction side and an apparatus side wall section that is formed on a −Y axis direction side by being inserted in the mounting section in the −Y axis direction from the apparatus side insertion opening to the apparatus side wall section, where three spatial axes that are orthogonal to each other have an X axis, a Y axis, and a Z axis where, out of X axis directions along the X axis, a positive direction is a +X axis direction and a negative direction is a −X axis direction, out of Y axis directions along the Y axis, a positive direction is the +Y axis direction and a negative direction is the −Y axis direction, and out of Z axis directions along the Z axis, a positive direction is a +Z axis direction and a negative direction is a −Z axis direction, the liquid containing body comprising:

a flexibly liquid containing section that contains a liquid;

a substrate with a contact section that electrically connects due to contact with regard to an apparatus side terminal section provided in the apparatus side wall section; and a substrate support member supporting the substrate, the substrate support member including a first engaging section engaging with regard to the liquid containing vessel from the +Z axis direction side at a position more to the −Y axis direction side than the contact section, a second engaging section engaging with the liquid containing section at a position more to the +Y axis direction side than the substrate, and provided more to the −Z axis direction side than the contact section, a first pressed section configured to receive a first pressing force with a component in the −Z axis direction at a position more to the −Y axis direction side than the contact section, and a second pressed section configured to receive a second pressing force with a component in the −Z axis direction at a position more to the +Y axis direction side than the contact section and more to the +Z axis direction side than a position where the first pressed section receives the first pressing force, where the X axis, the Y axis, and the Z axis with regard to the liquid containing vessel in a state of being mounted in the mounting section are three spatial axes in the liquid containing vessel.

15. The liquid containing body according to claim 14, wherein the substrate support member further includes a substrate support section that holds the substrate with a posturing where the contact section faces the −Y axis direction and the +Z axis direction.

16. The liquid containing body according to claim 14, wherein there is a plurality of the first engaging sections.

17. A unit comprising:

a substrate having a contact section, the substrate being configured to be detachably attached to a liquid ejecting apparatus in an attaching and detaching direction, where three spatial axes that are orthogonal to each other have an X axis, a Y axis, and a Z axis where, out of Y axis directions along the Y axis, a positive direction is a +Y axis direction and a negative direction is a −Y axis direction, and out of Z axis directions along the Z axis, a positive direction is a +Z axis direction and a negative direction is a −Z axis direction, the attaching and detaching direction being the Y axis directions;

a first pressed section pressed in the −Z axis direction at a position more to a downstream side, which is a side of the −Y axis direction, than the contact section; and a second pressed section pressed in the −Z axis direction at a position more to an upstream side, which is a side of the +Y axis direction, than the contact section and more to a side of the +Z axis direction than a position where the first pressed section is pressed.

* * * * *